US007909118B2

(12) United States Patent
Sanfelice et al.

(10) Patent No.: US 7,909,118 B2
(45) Date of Patent: Mar. 22, 2011

(54) APPARATUS AND METHOD FOR POSITIONING EXTENDED LATERAL CHANNEL WELL STIMULATION EQUIPMENT

(76) Inventors: Rudy Sanfelice, Helper, UT (US); William C. Davis, Centennial, CO (US); Christopher Sanfelice, Centennial, CO (US); Bradley A. Pomeroy, Englewood, CO (US)

( * ) Notice: Subject to any disclaimer, the term of this patent is extended or adjusted under 35 U.S.C. 154(b) by 94 days.

(21) Appl. No.: 12/364,491

(22) Filed: Feb. 2, 2009

(65) Prior Publication Data

US 2009/0218143 A1 Sep. 3, 2009

Related U.S. Application Data

(60) Provisional application No. 61/025,380, filed on Feb. 1, 2008, provisional application No. 61/104,651, filed on Oct. 10, 2008.

(51) Int. Cl.
*E21B 7/06* (2006.01)

(52) U.S. Cl. ..... 175/62; 175/75; 166/298; 166/117.6

(58) Field of Classification Search ..... 166/298, 166/255.2, 255.3, 55.1, 117.6; 175/61, 81, 175/78, 62, 73, 75

See application file for complete search history.

(56) References Cited

U.S. PATENT DOCUMENTS

| | | | | |
|---|---|---|---|---|
| 1,367,042 | A | 2/1921 | Granville | |
| 2,500,785 | A * | 3/1950 | Arutunoff | 175/78 |
| 4,368,786 | A * | 1/1983 | Cousins | 175/78 |
| 4,640,353 | A * | 2/1987 | Schuh | 166/248 |
| 5,183,111 | A | 2/1993 | Schellstede | |
| 5,413,184 | A | 5/1995 | Landers | |
| 5,462,120 | A * | 10/1995 | Gondouin | 166/380 |
| 5,853,056 | A | 12/1998 | Landers | |
| 6,035,935 | A * | 3/2000 | Regalbuto | 166/298 |
| 6,189,629 | B1 | 2/2001 | McLeod et al. | |
| 6,257,353 | B1 | 7/2001 | Belew et al. | |
| 6,260,623 | B1 | 7/2001 | Schick | |
| 6,263,984 | B1 | 7/2001 | Buckman, Sr. | |
| 6,412,578 | B1 | 7/2002 | Baird | |
| 6,550,553 | B2 | 4/2003 | Baird | |
| 6,578,636 | B2 | 6/2003 | Mazorow et al. | |
| 6,688,702 | B1 | 2/2004 | Abramov et al. | |
| 6,695,056 | B2 * | 2/2004 | Haugen et al. | 166/297 |
| 6,772,839 | B1 | 8/2004 | Bond | |
| 7,455,127 | B2 * | 11/2008 | Schick | 175/61 |
| 7,537,055 | B2 * | 5/2009 | Head et al. | 166/298 |
| 2001/0045282 | A1 * | 11/2001 | Robinson | 166/298 |

* cited by examiner

*Primary Examiner* — Kenneth Thompson
*Assistant Examiner* — Catherine Loikith
(74) *Attorney, Agent, or Firm* — James R. Young; William W. Cochran; Cochran Freund & Young LLC

(57) ABSTRACT

A movable boring assembly and a boring tool positioner for drilling a plurality of holes in a well casing and jetting a well production zone through the plurality of holes. All of the holes can be drilled in the casing at different angular positions, as well as different levels within the casing. The drilling tool can then be removed and a perforation jet can be reliably and accurately reoriented into the drilled holes to perforate a production zone in multiple directions and at multiple levels.

24 Claims, 29 Drawing Sheets

APPARATUS AND METHOD FOR POSITIONING EXTENDED LATERAL CHANNEL WELL STIMULATION EQUIPMENT

CROSS-REFERENCE TO RELATED APPLICATIONS

This application is based upon and claims the benefit of U.S. provisional application Ser. No. 61/025,380, entitled "APPARATUS AND METHOD FOR POSITIONING EXTENDED LATERAL CHANNEL WELL STIMULATION EQUIPMENT," filed Feb. 1, 2008, and U.S. provisional application Ser. No. 61/104,651, entitled "APPARATUS AND METHOD FOR POSITIONING EXTENDED LATERAL CHANNEL WELL STIMULATION EQUIPMENT," filed Oct. 10, 2008, the entire disclosures of which are herein specifically incorporated by reference for all that they disclose and teach.

BACKGROUND OF THE INVENTION

Oil and gas well stimulation and mineral recovery equipment has been used for radially hole boring through well casings into oil, gas, or mineral bearing geological formations.

Oil and gas wells are drilled into oil and/or gas bearing geological formations, and, when a combination of porosity and pressure gradient in the formation are sufficient, the oil and/or gas in the formation flows to the well bore, from which it either flows to the surface of the ground under pressure or can be extracted by pumping. However, if either porosity of the formation or the pressure gradient is insufficient, flow rates of the oil and/or gas to the well bore may not enough for the well to produce at its full potential and, in some cases, even to operate or produce the well economically. This condition can be encountered in new wells and may develop over time in older wells.

To address these problems, many techniques have been developed for stimulating production from the formation, including, for example, treating the formation with acid, hydraulically fracturing the formation and propping the fractures open with porous propant materials and injecting water or other fluids into the formation from nearby wells to push or induce increased flow of the oil and/or gas to the well bore. Such stimulation techniques can also be used in water wells as well as to make a formation less resistant to injection of fluids, such as water, and to facilitate mineral recovery from mines, and other operations involving production from, and/or injection of fluids into, geological formations.

SUMMARY OF THE INVENTION

The present invention may therefore comprise a movable boring assembly for drilling a plurality of holes in a well casing and jetting a well production zone through the plurality of holes at a plurality of levels and in a plurality of directions comprising: a boring tool positioner that orients a drill tool to cut the plurality of holes in the plurality of directions in the well casing and orient a perforation jet in the plurality of holes to perforate the well production zone in the plurality of directions; an antirotation mandrel coupled to a lower end of the boring tool positioner; a bow spring anchor that engages the antirotation mandrel to prevent the boring tool positioner from rotating; a releasable packer that releasably couples to the well casing; a packer mandrel that rotates in the releasable packer to orient the boring tool positioner in the plurality of directions to cut the plurality of holes in the well casing and to orient the perforation jet in the plurality of holes, and to vertically move the boring tool positioner to more than one level in the well to bore holes and perforate production zones through the holes in the well casing at more than one level.

The present invention may further comprise a boring tool positioner that orients a drill tool to cut a plurality of holes in a plurality of directions in a well casing and reliably and accurately reorients a perforation jet in the plurality of holes to perforate a production zone through the plurality of holes in the well casing comprising: a housing sleeve having a plurality of apertures distributed around a circumferential wall on the housing sleeve; a tool guide cylinder positioned rotatably in the housing sleeve that orients the drill tool and the perforation jet with the plurality of apertures; an angular positioner that controls rotational movement of the tool guide cylinder in the housing sleeve in a manner that causes a releasable, self-latching engagement between the tool guide cylinder and the housing sleeve to accurately and repeatably align the tool guide cylinder with the housing sleeve so that the drill tool and the perforation jet are accurately and repeatably aligned with the plurality of apertures.

The present invention may further comprise a method of orienting a drill tool to cut a plurality of holes in a plurality of directions in a well casing of a well and reliably and accurately reorienting a perforation jet in the plurality of holes to perforate a production zone through the plurality of holes in the well casing comprising: providing a housing sleeve having a plurality of apertures distributed around a circumferential wall of the housing sleeve; holding the housing sleeve so that the housing sleeve does not rotate in the well; rotating a tool guide cylinder in the housing sleeve; aligning the tool guide cylinder in the housing sleeve so that the drill tool and the perforation jet are accurately and repeatably aligned with the apertures.

BRIEF DESCRIPTION OF THE DRAWINGS

The accompanying drawings, which are incorporated in and form a part of the specification, illustrate example implementations of the invention, which is defined by the claims, and they are not intended to imply that the claimed inventions are limited to these or any particular examples or illustrations. In the drawings:

DETAILED DESCRIPTION OF EXAMPLE EMBODIMENTS

Figure 1:
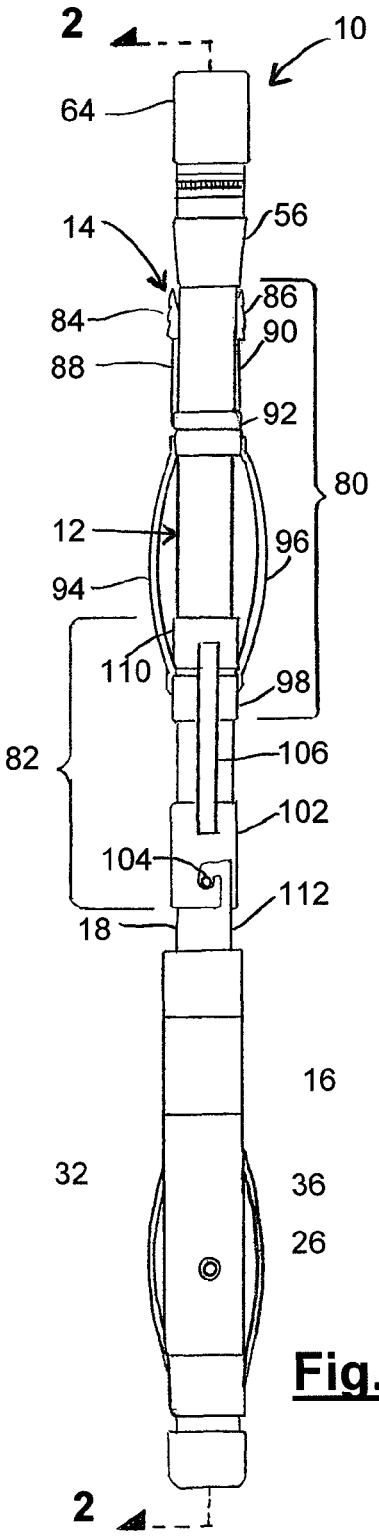
FIG. 1 is a side elevation view of an example boring tool positioning apparatus.
Figure 2:
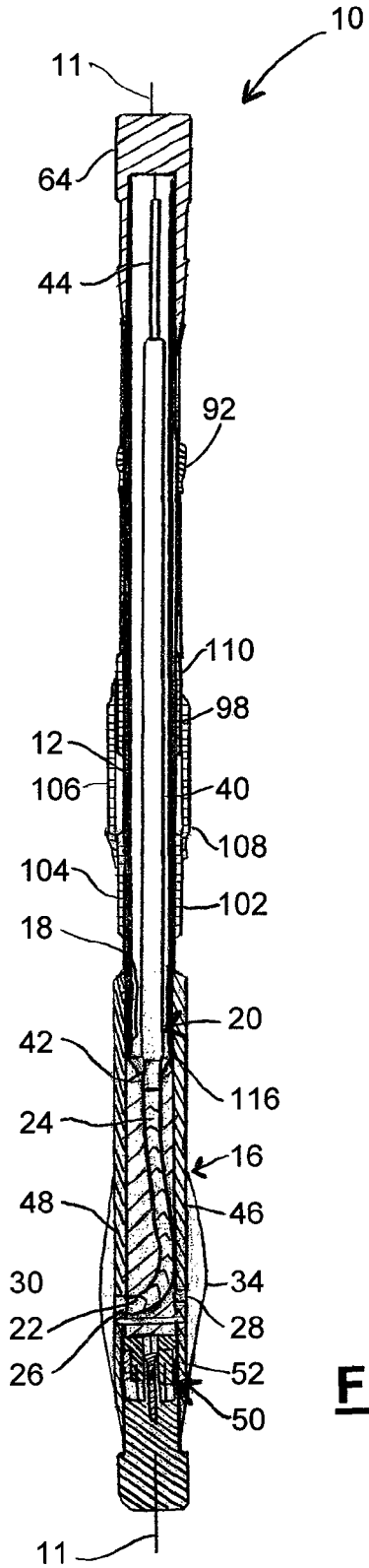
FIG. 2 is a cross-section view of the example boring tool positioning apparatus taken along the section line 2-2.

An example formation hole boring tool positioning apparatus 10 is shown diagrammatically in FIG. 1, but recognizing that the invention recited in the claims below can also be implemented in myriad other ways, once the principles are understood from the description herein. Also, this example implementation is shown in a side elevation view of the assembled boring tool positioning apparatus 10 for the purpose of general orientation, but, because it is a fairly elongated apparatus, it must be recognized that the scale as well as the two-dimensional representation has inherent limitations in showing details of the apparatus, some of which will be described or explained in more detail below and/or shown in subsequent views. A cross-sectional view of the example radial hole boring tool positioning apparatus 10 taken along the section line 2-2 in FIG. 1 is shown in FIG. 2 to supplement the initial general orientation description. In the drawings and this description, "upwardly", "downwardly", "top", "bottom", "under", "over", and similar directional prepositions are used for convenience to describe components, features, and functions of the positioning apparatus 10 as it would be positioned in a typical vertical well, which is as it is depicted in the drawings, but recognizing that in some directionally drilled wells, mining operations, and other applications, the longitudinal axis 11 of the tool positioning apparatus 10 might be slanted to vertical or even horizontal. Therefore, in a generic sense, the prepositions relating generally to the upward direction are toward the opening of the well or other bore hole at the surface of the ground, and those relating to the downward direction are away from the opening and into the formation.

The example hole boring tool positioning apparatus 10 shown in FIGS. 1 and 2 is an elongated structure that has a diameter sized to fit and slide into a well casing, as will be described in more detail below, including an elongated carrier pipe 12 that serves as the primary structural frame and carrier of the principal components of the boring tool positioning apparatus 10. An anchor assembly 14 positioned around the carrier pipe 12 is provided for setting and anchoring the boring tool positioning apparatus 10 at a desired depth in the well (not shown in FIGS. 1 and 2), for example, in the pay zone of a reservoir formation (not shown in FIGS. 1 and 2). A boring tool orienting assembly 16 is attached to the bottom end 18 of the carrier pipe 12 for orienting the casing drill tool 20 and formation jet boring tool (not shown in FIGS. 1 and 2), as will be discussed in more detail below.

The casing drill tool 20 is shown in FIG. 2 for an overview of how the components are generally assembled together, but, because of limitations of scale and the two-dimensional drawing, are not entirely accurate in FIG. 2. For example, in use, the casing drill tool 20 would probably not be lowered into the positioning apparatus 10 until the positioning apparatus 10 is already set and anchored in the well casing (not shown in FIG. 2), as will be discussed below. Also, the drill bit or cutting tool 22 on the distal end of the flexible shaft 24 of the casing drill tool 20 is guided through the drill aperture 26 to cut or drill a hole (not shown in FIG. 2) through the casing (not shown in FIG. 2), so none of the centralizer retainer apparatus of the orienting assembly 16, such as the leaf spring 30, would not ordinarily be positioned in the same angular position on the orienting assembly 16 as the drill aperture 26 where it could block the drill bit 22 from reaching the casing (not shown in FIGS. 1 and 2).

The drill tool 20 is generally comprised of an elongated hydraulic motor 40 (sometimes called a "mud motor" because it can be driven by the weighted circulating fluid in an oil well that is often called "mud"), which has a rotatable drive shaft 42 protruding axially at the bottom end. The flexible shaft 24 is connected to the drive shaft 42, so, when the hydraulic motor 40 turns the drive shaft 42, it turns the drill bit 22 via the flexible shaft 24 to drill a hole through the casing (not shown in FIGS. 1 and 2.). A hydraulic fluid under pressure for driving the hydraulic motor 40 is delivered from a pump (not show) at the surface of the ground (not shown) to the hydraulic motor 40 by a high-pressure tube or hose 44. Hydraulic motors or mud motors are well known in the oil and gas industry and readily available sizes and configurations that are suitable for the use described herein. Also, flexible shafts are well know and readily available. Any single or double ball-jointed or wire wound flexible shaft or other flexible shaft structure that can fit in the tool described herein and transmit the power from the hydraulic motor is suitable for this purpose.

A rotatable tool guide cylinder 46 with a curved guide channel 48 in the boring tool orienting assembly 16 is rotatable about the longitudinal axis 11 of the positioning apparatus 10 for guiding the bit 22 and flexible shaft 24 to the appropriate drill apertures, e.g., apertures 26, 28 (and others not seen in FIGS. 1 and 2), as will be explained in more detail below. Angular positioning apparatus 50 in the boring tool orienting assembly 16 interacts with the rotatable tool guide cylinder 46 for facilitating precision angular orientation of the rotatable guide cylinder 46 to align the distal end 52 of the guide channel 48 with selected ones of the drill apertures, e.g., drill aperture 26, 28 (and others not seen in FIGS. 1 and 2), as will also be explained in more detail below.

Figure 3A:
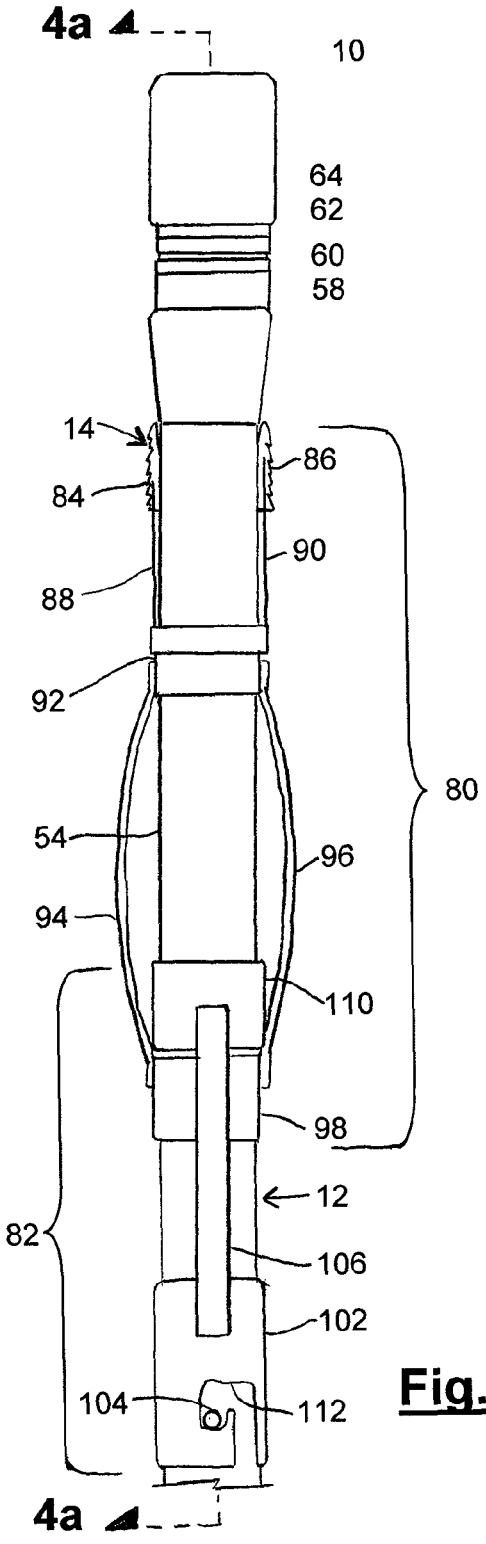
FIGS. 3*a-b* are enlarged views of the upper and lower portions, respectively, of the example boring tool positioning apparatus in FIG. 1.
Figure 3B:
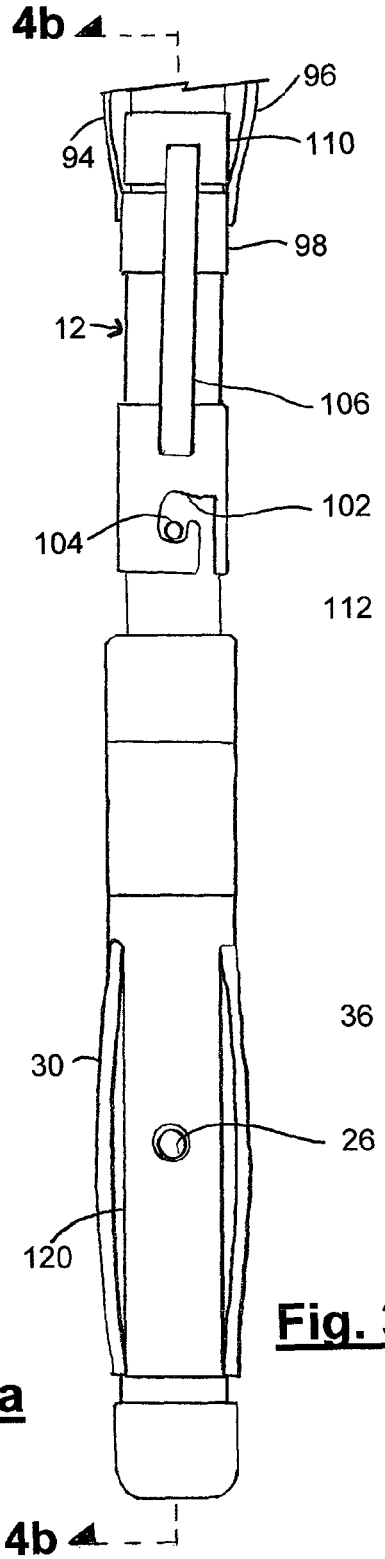
Figure 4A:
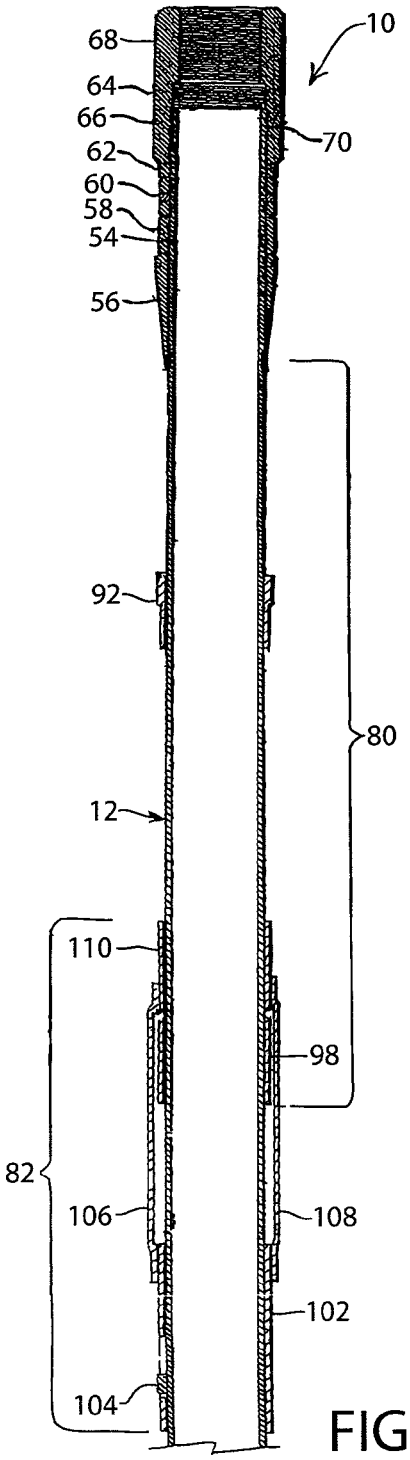
FIGS. 4*a-b* are enlarged cross-sectional views of the example boring tool positioning apparatus similar in orientation to FIG. 2.
Figure 4B:
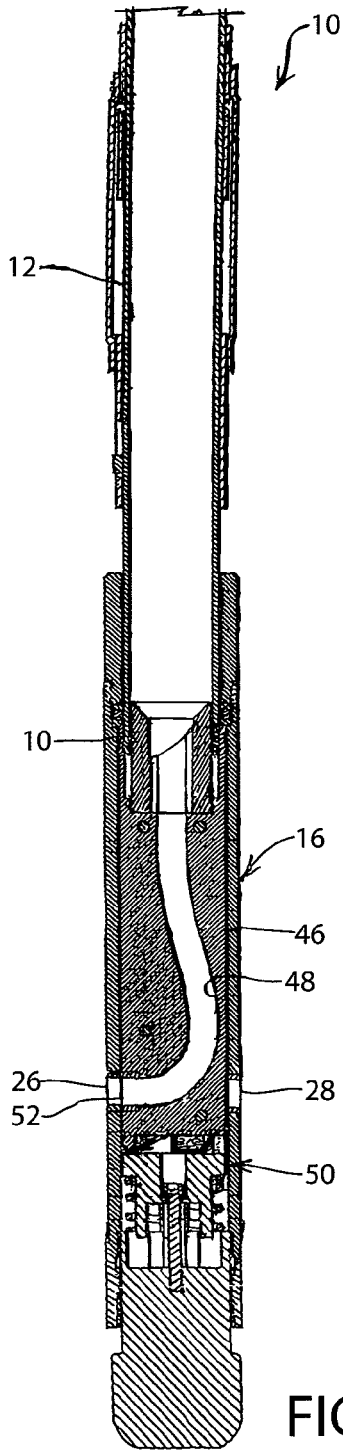

The example boring tool positioning apparatus 10 is shown in a larger scale in FIGS. 3*a-b* and 4*a-b*, wherein the upper portion is shown in FIGS. 3*a* and 4*a* and the lower portion is shown in FIGS. 3*b* and 4*b* with some overlap of components between the upper FIGS. 3*a* and 4*a* and the lower FIGS. 3*b* and 4*b*. The cross-section view in FIG. 4*a-b* illustrates the boring tool positioning apparatus 10 without the drill tool 20 in place, which is the way it would normally be run into the well (not shown in FIGS. 3*a-b* and 4*a-b*), set, and anchored in place in the well. Then, after the positioning apparatus 10 is set and anchored in the well, as will be explained below, the drill tool 20 is dropped through the well and into the positioning apparatus 10, as will also be explained below.

Figure 5:
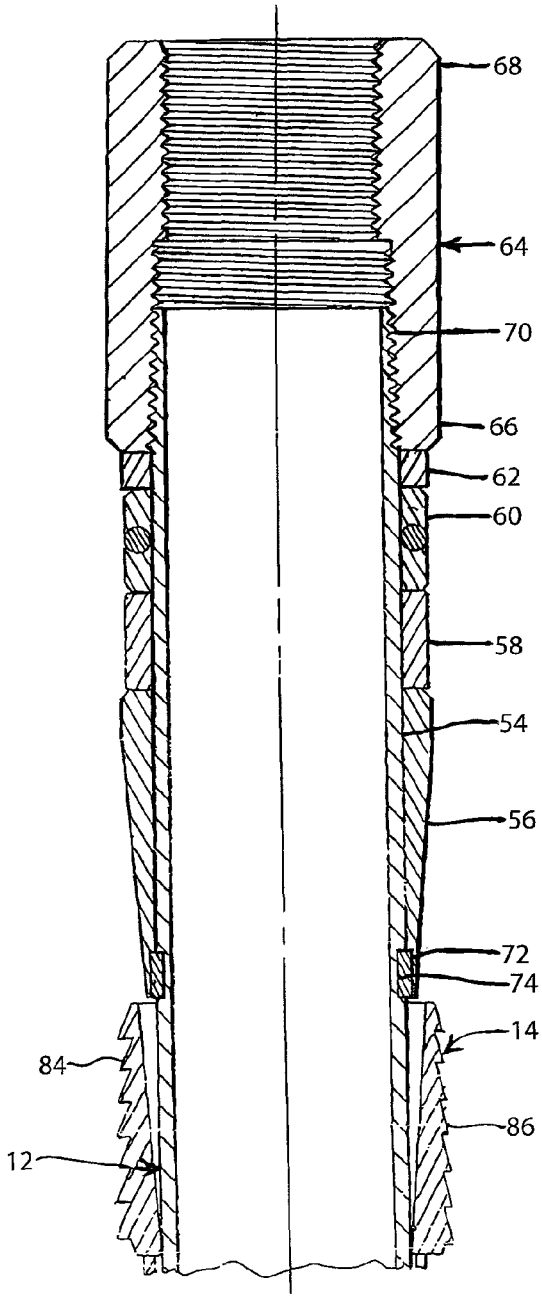
FIG. 5 is an enlarged cross-section view of the top end of the boring tool positioning apparatus.

As best seen in the upper FIGS. 3*a* and 4*a* supplemented by FIG. 5 (similar to the upper part of FIG. 4*a* but enlarged and rotated 90 degrees), the upper portion 54 of the carrier pipe 12 extends through a wedge sleeve 56, lower spacer ring 58, axial thrust bearing 60, and upper spacer ring 62 into a pipe coupling 64. The pipe coupling 64 is internally sized and threaded in its bottom portion 66 to receive and fasten to the externally threaded upper end 70 of the carrier pipe 12, and the upper portion 68 of the pipe coupling 64 is internally sized and threaded to receive and fasten to an externally threaded lower end of an upset tubing string or production tubing string of a well (not shown in FIGS. 3*a*, 4*a*, and 5), which is used to lower the positioning apparatus 10 into the well and to manipulate the anchor apparatus 14 and boring tool orienting assembly 16, as will be described in more detail below. A split ring 72 set into a corresponding annular groove 74 in the carrier pipe 12 provides a bottom limit to downward movement of the wedge sleeve 56. Therefore, when the pipe coupling 64 is screwed onto the upper end 70 of the carrier pipe 12, the upper spacer ring 58, thrust bearing 60, lower spacer ring 58, and wedge sleeve 56 are captured between the coupling 64 and the spit ring 72 so that they cannot move longitudinally upwardly and downwardly on the carrier pipe 12, but the carrier pipe 12 is rotatable with respect to the wedge sleeve 56. Such rotatability of the carrier pipe 12 with respect to the wedge sleeve 56 allows the carrier pipe 12 to be rotated by the upset/production tubing (not shown in FIGS. 3*a*, 4*a*, and 5) in order to manipulate the boring tool orienting assembly 16 while the wedge sleeve 56 is fixed immovably in the well casing (not shown in FIGS. 3*a*, 4*a*, and 5) by the anchor assembly 14, which, when set, prevents the carrier pipe 12 from moving longitudinally up and down in the well. Likewise, the carrier pipe 12 is rotatable within the components of the anchor assembly 14, which will be described in more detail below.

Figure 6:
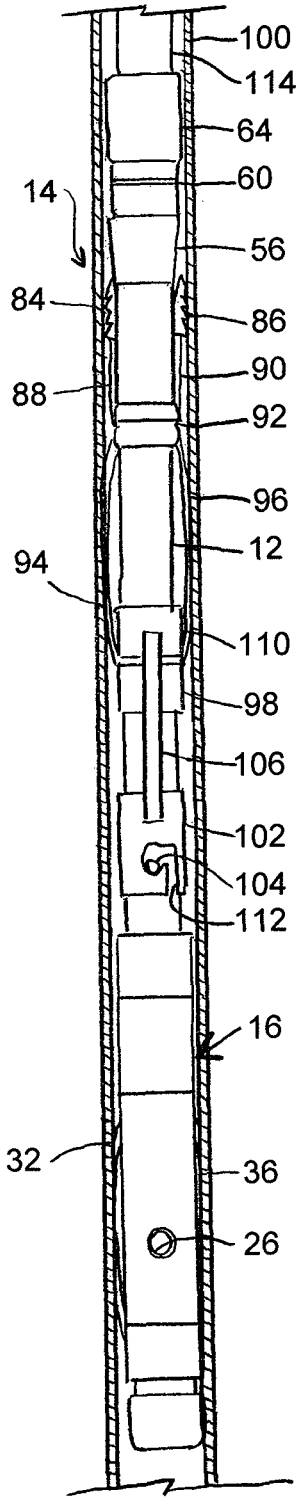
FIG. 6 is a side elevation view of the example boring tool positioning apparatus as first positioned in a well casing before it is anchored in position.
Figure 7:
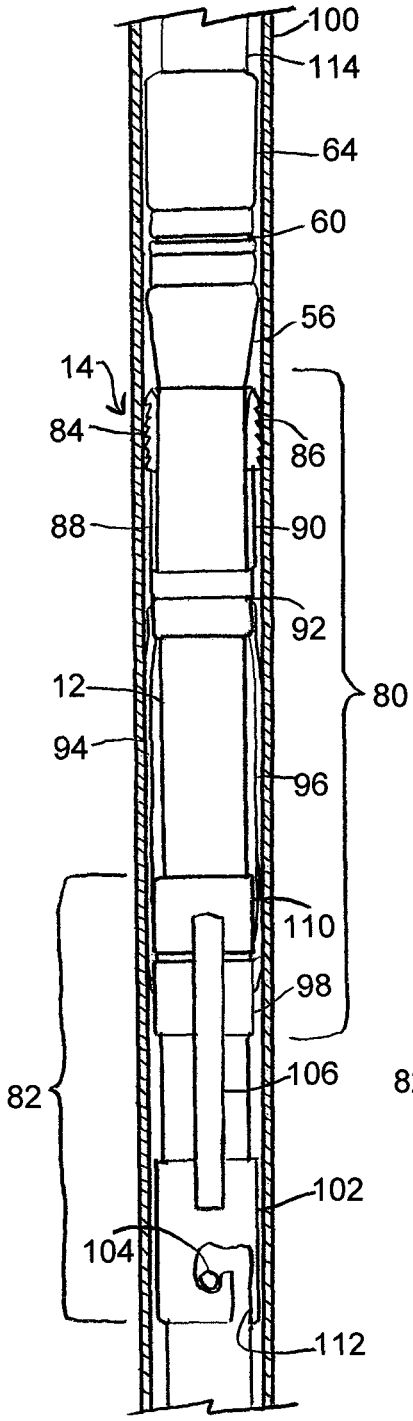
FIG. 7 is a side elevation view of the upper portion of the example boring tool positioning apparatus in a well casing showing the anchor assembly before it is anchored in position.
Figure 8:
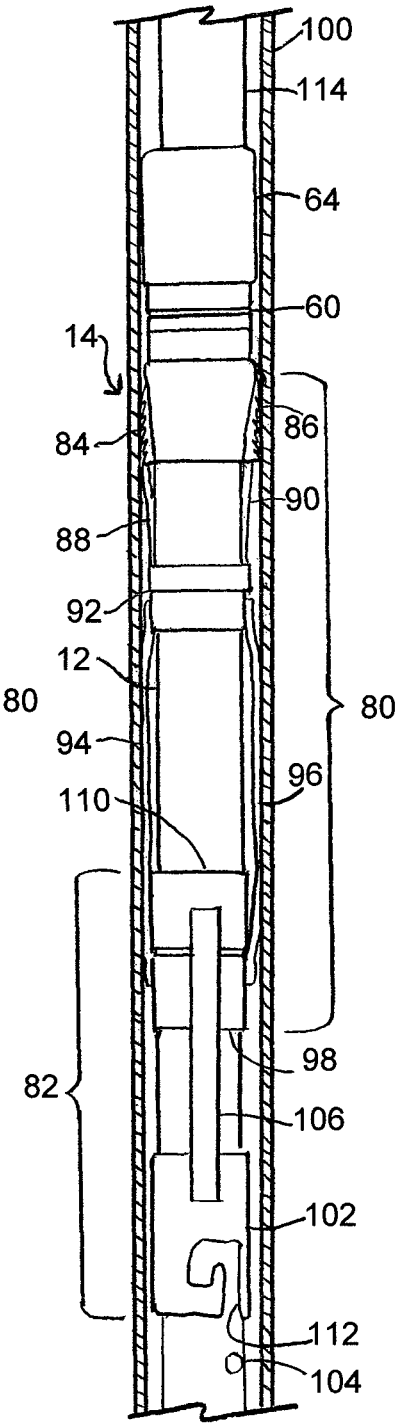
FIG. 8 is a side elevation view similar to FIG. 7, but after the anchor assembly is set to anchor the example boring tool positioning apparatus in position in the well casing.

Referring again primarily to FIGS. 3*a* and 4*a* as well as to FIGS. 6-8, the anchor assembly 14 comprises two overlapping subassemblies—a wedge subassembly 80 and a setting and releasing subassembly 82, which interact with each other to set and anchor the tool positioning apparatus 10 in the well casing 100 (FIGS. 6-8). The wedge subassembly includes a plurality of wedge pieces, for example, wedge pieces 84, 86, positioned slidably along the outside surface of the upper portion 54 of the carrier pipe 12 just under the wedge sleeve 56. The wedge pieces 84, 86 are attached to the upper ends of two strap iron struts 88, 90, respectively, which are connected at their bottom ends to a cuff 92, which encircles and is slidably movable on the carrier pipe 12, and the carrier pipe 12 is rotatable in the cuff 92. A plurality of leaf springs, for example, leaf springs 94, 96, extend downwardly from the cuff 92 and attach to a sleeve 98 positioned slidably around the carrier pipe 12 at a distance below the cuff 92. The leaf springs 94, 96 bow outwardly between the cuff 92 and the sleeve 98 for engagement with the well casing 100 when the tool positioning apparatus 10 is inserted into the casing 100.

The setting and releasing subassembly 82 comprises a bayonet collar 102 encircling the carrier pipe 12 in a slidable and rotatable manner for engaging and disengaging a bayonet pin 104 protruding radially from the carrier pipe 12 below the sleeve 98 of the wedge subassembly 80. A plurality of rigid bracket straps or bars, for example, bracket bars 106, 108, extend upwardly from the bayonet collar 102 to a bracket band 110 positioned slidably around the carrier pipe 12 above the sleeve 98 of the wedge subassembly 80. The bracket bars 106, 108 are long enough between the bracket band 110 and the bayonet collar 102 such that the setting and releasing subassembly 82 has a range of motion upwardly and downwardly on the carrier pipe 12 independent of the wedge subassembly 80, but limited in the upward direction by the bayonet collar 102 coming into abutment with the sleeve 98 and limited in the downward direction by the bracket band 110 coming into abutment with the sleeve 98. The J-slot 112 in the bayonet collar 102 allows the pin 104 to engage the collar 102 for setting and releasing the wedge pieces 84, 86 to anchor and release the tool positioning apparatus 10 in the casing 100, as will be described in more detail below, and it allows the disengagement of the collar 102 from the pin 104 for manipulating the boring tool orienting assembly 16 with the upset/production tubing via the carrier pipe 12 to set the angular orientation of the drilling tool 20 while the wedge subassembly 80 anchors the tool positioning apparatus 10 in the casing 100, as will also be described below.

Referring now primarily to FIGS. 6-8, the boring tool positioning apparatus 10 is shown in FIG. 6, connected by the pipe coupling 64 to the bottom end of an upset or production tubing string 114 and inserted into a well casing 100. The surrounding formation is not shown in FIGS. 6-8 to avoid unnecessary clutter. The leaf springs 94, 96 of the wedge subassembly 80 and the leaf springs 30, 32, 34, 36 of the centralizer apparatus on the boring tool orienting assembly 16 are forcibly deflected by the casing 100 inwardly against their spring bias toward the longitudinal axis 11 as the boring tool positioning apparatus 10 is forced by the upset/production tubing string 114 into the well, and they drag against the inside surface of the casing 100 all the way down into the well. Therefore, with particular attention to the anchor assembly 14, the bayonet pin 104 protruding from the carrier pipe 12 and engaged in the J-slot 112 with the bayonet collar 102 applies a downward force on the collar 102, bracket bars 106, 108, and bracket band 110 of the setting and releasing subassembly 82. Consequently, the setting and releasing subassembly 82 slides downwardly on the carrier pipe 12 until the bracket band 110 abuts the sleeve 98 of the wedge subassembly 80, whereupon the downward force is transferred to the wedge subassembly 80 to overcome the frictional drag of the leaf springs 94, 96 to pull the wedge subassembly 80 downwardly through the casing 100 along with the rest of the tool positioning apparatus 10, as shown in FIGS. 6 and 7, to the desired depth in the well.

Once the desired depth is reached, the operator on the surface of the ground pulls up slightly on the upset/production tubing string 114, which pulls the carrier pipe 12 upwardly and thereby causes the pin 104 protruding from the carrier pipe 12 to move upwardly in the J-slot 112 enough to dislodge the pin 104 from the closed end of the J-slot 112. If necessary, the upset/production tubing string 114 can be pulled upwardly enough to cause the collar 102 to abut the sleeve 98, which is held stationary by the friction of the leaf springs 94, 96, in order to dislodge the pin 104 from the closed end of the J-slot 112, whereupon the operator then rotates the upset/production tubing string 114 counter-clockwise to thereby rotate the carrier pipe 12 enough to align the pin 104 with the open end of the J-slot 112, and then the operator lowers the upset/production tubing string 114 and carrier pipe 12 to remove the pin 104 from the J-slot 112, as illustrated in FIG. 8. As also illustrated in FIG. 8, as the carrier pipe 12 is lowered with the pin 104 out of the J-slot 112 and the friction of the leaf springs 94, 96 holding the wedge subassembly 80 stationary in the casing 80, the downward movement of the carrier pipe 12 in relation to the stationary wedge subassembly 80 causes the wedge sleeve 56, which moves longitudinally with the carrier pipe 12, to also move downwardly between the wedge pieces 84, 86. Such downward movement of the wedge sleeve 56 with the carrier pipe 12 causes the tapered conical surface of the wedge sleeve 56 to force the wedge pieces 84, 86, which are constrained against downward movement by the struts 88, 90, radially outward to thereby jam or wedge them between the wedge sleeve 56 and the casing 100. With the wedge pieces 84, 86 wedged between the wedge sleeve 56 and casing 100, the wedge sleeve 56 will not move up or down in the casing 100, and, since the carrier pipe 12 cannot move longitudinally in relation to the wedge sleeve 56, such jamming of the wedge pieces 84, 86 between the wedge sleeve 56 and the casing 100 effectively anchors the carrier pipe 12 in that position in the well. However, with the wedge sleeve 56 and carrier pipe 12 anchored against longitudinal movement in the casing 100, the carrier pipe 12 is still rotatable in relation to the wedge sleeve 56, as facilitated by the thrust bearing 60, so the carrier pipe 12 can be rotated by the operator by rotating the upset/production tubing string 114 to manipulate the boring tool orienting assembly 16, as will be described below.

After the reservoir boring operations, which will be described below, are completed, the operator can disengage the anchor assembly 14 by pulling upwardly on the upset/production tubing string 112, thus pulling the carrier pipe 12 upwardly in relation to the wedge subassembly 80, which pulls the wedge sleeve 56 upwardly and away from the wedge pieces 84, 86, thereby releasing the radially outward force components on the wedge pieces 84, 86 to disengage them from the casing 100. As the upset/production tubing string 111 continues to pull the carrier pipe 12 upwardly, the wedge subassembly initially remains stationary in the casing 100 due to the frictional engagement of the leaf springs 94, 96 on the inside surface of the casing 100. However, with further upward movement of the carrier pipe 12, the pin 104 bearing on the collar 102 pushes the setting and releasing subassembly 82 upwardly along with the carrier pipe 12 until the collar 102 reaches and pushes upwardly on the sleeve 98, whereupon continued upward movement of the carrier pipe 12 cause the upward force of the pin 104 and collar 102 on the sleeve 98 to overcome the frictional resistance of the leaf springs 94, 96 on the casing 100 to push the wedge subassembly 80 along with the rest of the tool positioning apparatus 10 upwardly and out of the well.

Turning now to the boring tool orienting assembly 16, after the tool positioning apparatus 10 is set and anchored in the casing 100 at a desired depth in a reservoir formation, as explained above, the drill tool 20 (FIG. 2) is connected to and suspended on the end of the hydraulic fluid tube or hose 44 and lowered from the surface of the ground (not shown) through the upset/production tubing string 112 (FIGS. 6-8) into the anchored tool positioning apparatus 10. As shown generally in FIG. 2, the flexible shaft 24 of the drill tool 20 with the drill cutter or bit 22 connected to the distal end of the flexible shaft 24 gets guided initially by a socket 116 on the top end of a rotatable tool guide cylinder 46 into a curved guide channel 48 in the guide cylinder 46.

Figure 9:
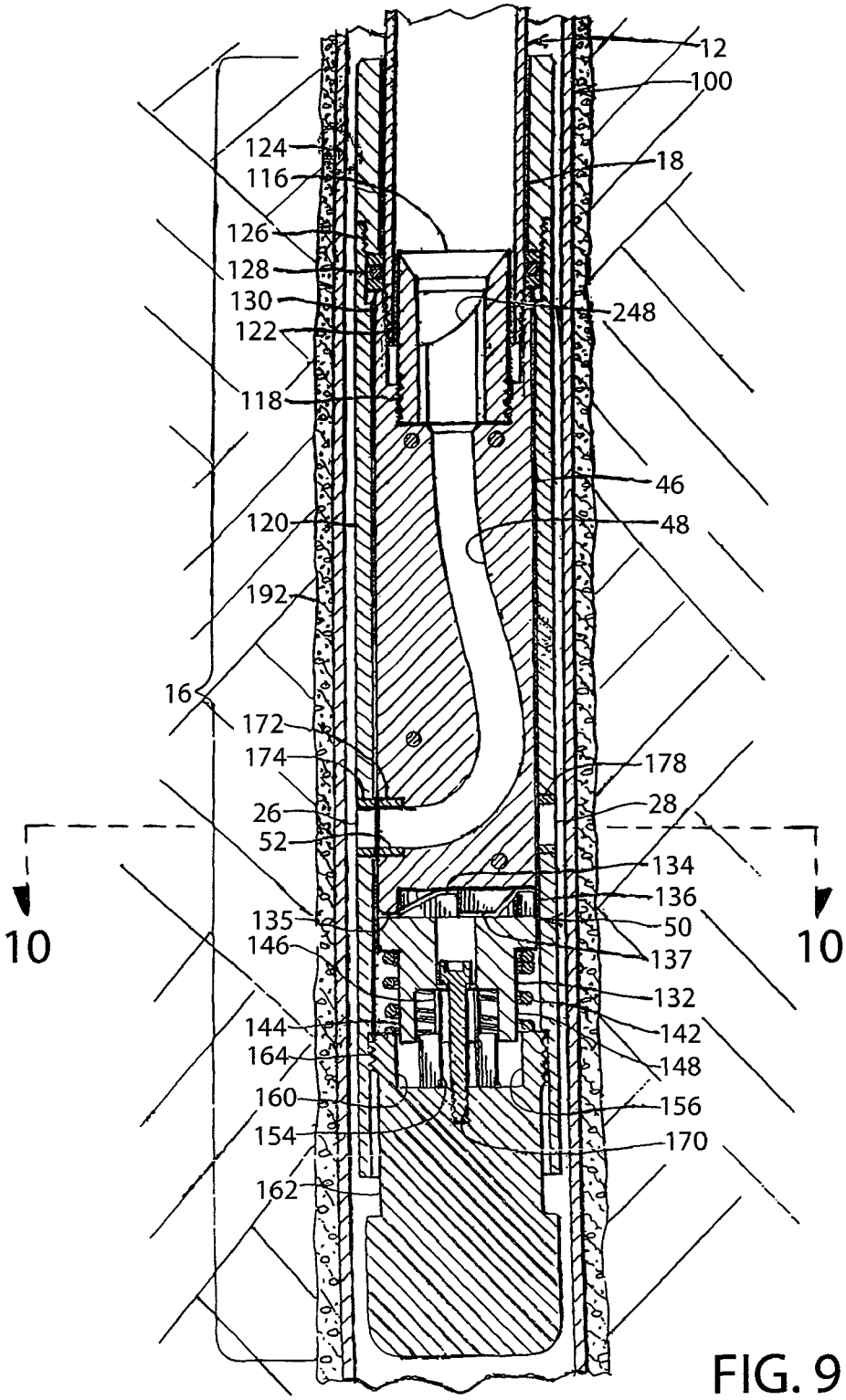
FIG. 9 is an enlarged cross-section view of the boring tool orienting assembly portion of the example boring tool positioning apparatus in a similar orientation as FIG. 2.
Figure 10:
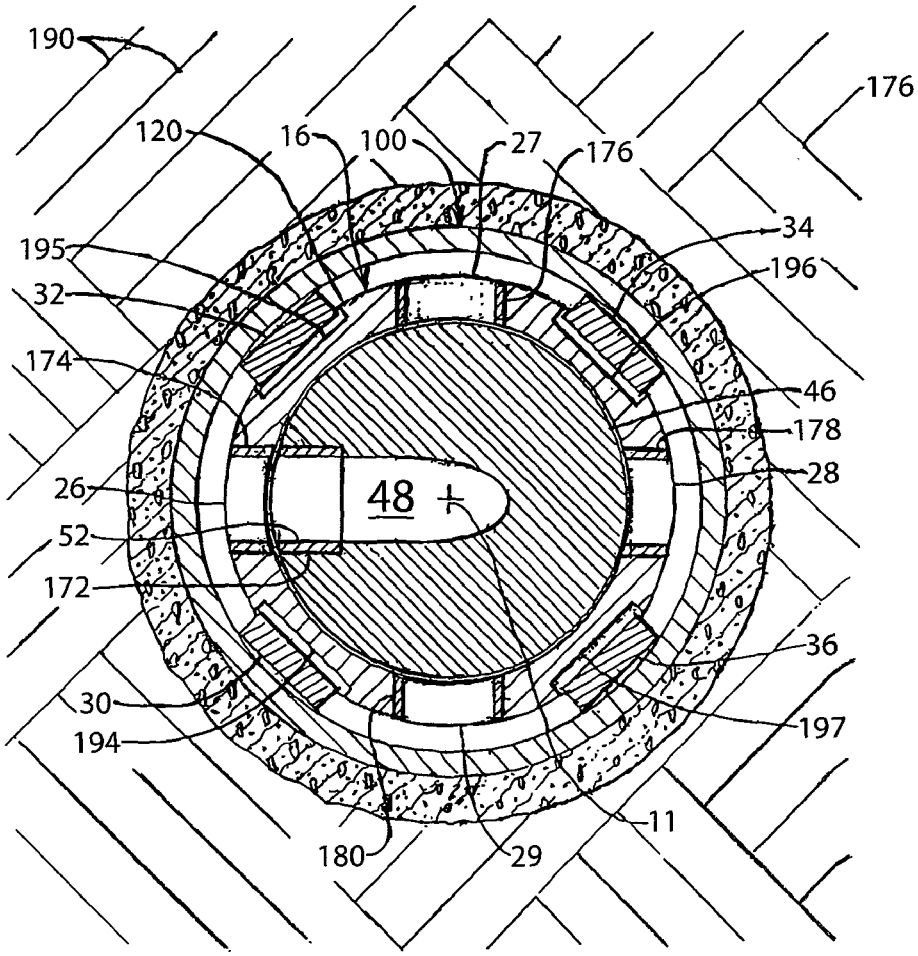
FIG. 10 is a transverse cross-section view of the boring tool orienting assembly taken along section line 10-10 in FIG. 9.

Referring now primarily to FIGS. 9 and 10, the socket fitting 116 can be fastened to the top of the tool guide cylinder 46, for example, by pipe threads 118. The guide cylinder 46 is positioned rotatably in a housing sleeve 120 and attached by pipe threads 122 to the bottom end 18 of the carrier pipe 12. The housing sleeve 120 is attached to and suspended from a shoulder sleeve 124 by pipe threads 126, and the shoulder sleeve is supported by a thrust bearing 128 that bears on the top end 130 of the tool guide cylinder 46. Therefore, the carrier pipe 12 and the guide cylinder 46 are rotatable with respect to the shoulder sleeve 124 and housing sleeve 120 about the longitudinal axis 11. The housing sleeve 120 also has a plurality of drill apertures, for example, drill apertures 26, 27, 28, 29 distributed around the circumference of the housing sleeve 120 in a common plane that is perpendicular to the longitudinal axis 11, so that rotation of the guide cylinder 46 with respect to the housing sleeve 120 can align the distal end 52 of the guide channel 48 with any one of the drill apertures, e.g., drill apertures 26, 27, 28, 29.

Figure 11:
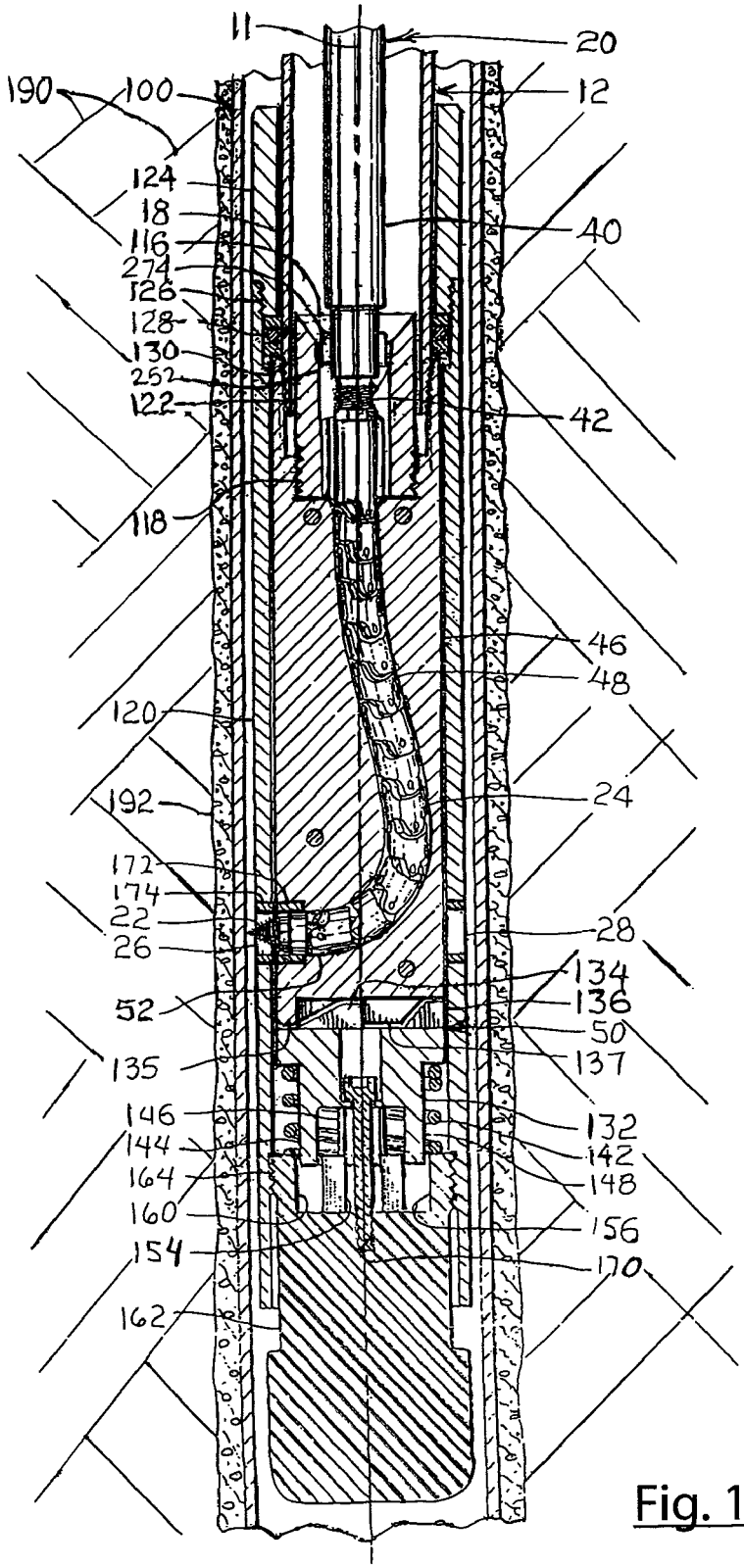
FIG. 11 is a cross-section view similar to FIG. 9, but with the example drill tool in position for use.

In the cross-section view of FIG. 9, two of the drill apertures 26, 28, which are diametrically opposite each other, are visible, but more than these two drill apertures 26, 28 can be provided. For example, in this example implementation, there are four drill apertures 26, 27, 28, 29, as shown in FIG. 10, distributed at angular increments of 90 degrees. These drill apertures 26, 27, 28, 29 allow the drill bit 22 to pass from the guide channel 48, through the housing sleeve 120, and into contact with the casing 100, as illustrated in FIG. 11 for drilling holes through the casing 100, as will be discussed in more detail below.

Figure 14:
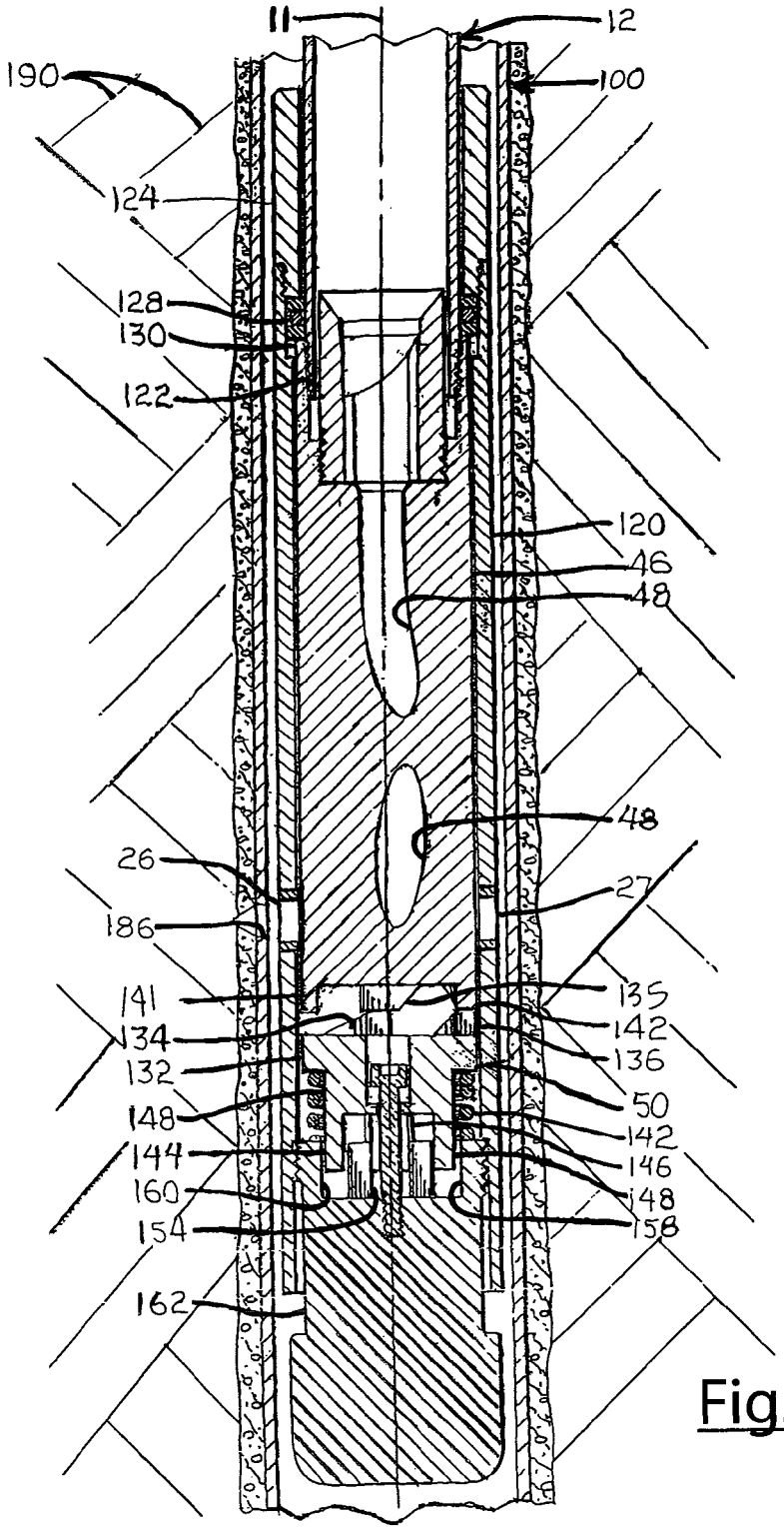
FIG. 14 is a cross-section view similar to FIG. 13, but with the tool guide cylinder rotated about 45 degrees toward the next successive drill aperture.
Figure 17:
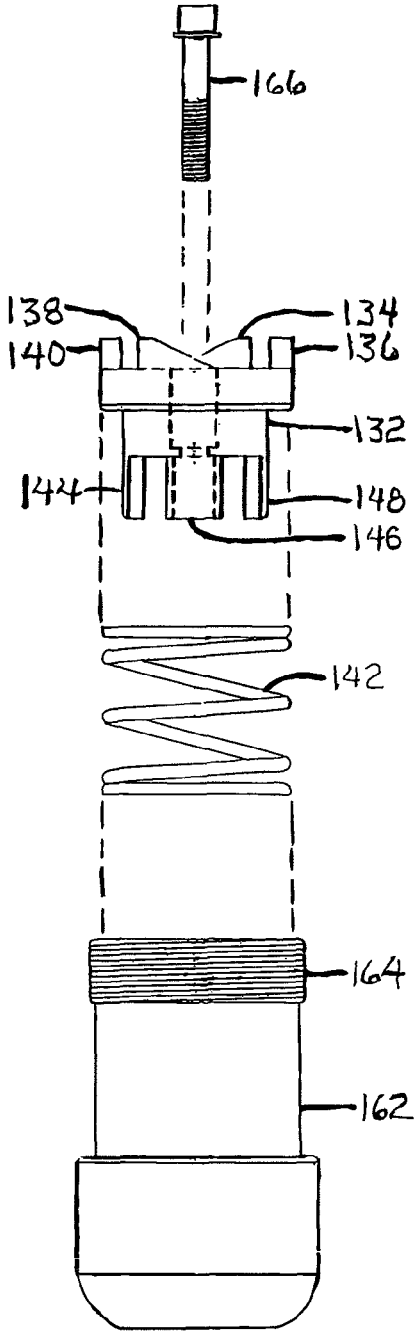
FIG. 17 is an exploded, side elevation view of the pawl hub and end plug components of an example angular positioning apparatus for the example boring tool positioning apparatus.
Figure 18:
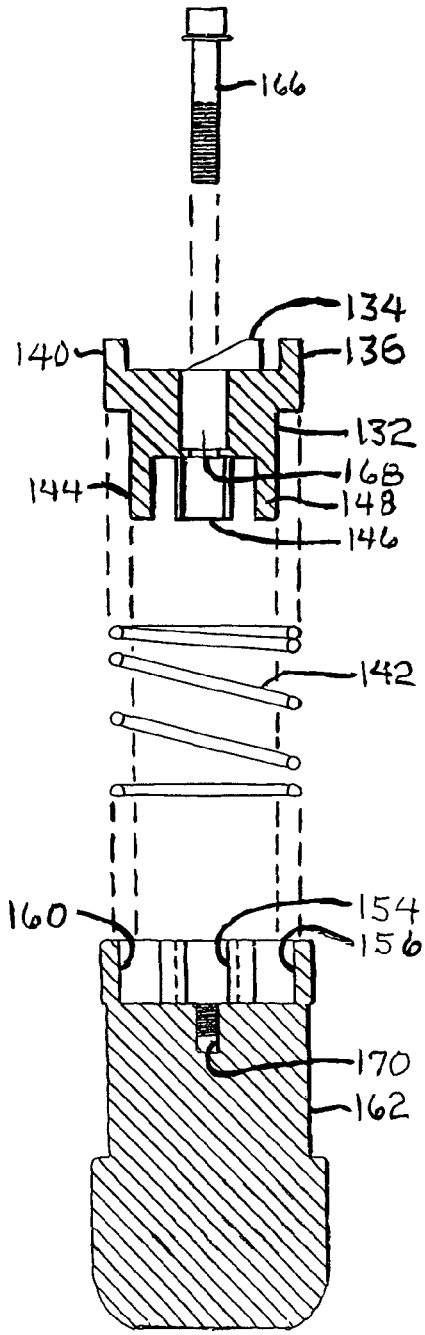
FIG. 18 is an exploded, longitudinal cross-section view of the pawl hub and end plug components of the example angular positioning apparatus shown in FIG. 17.

With continuing primary reference to FIG. 9 and secondary reference to FIGS. 14, 17, and 18, the tool orienting assembly 16 is also equipped with angular positioning apparatus 50, as mentioned briefly above, which interacts with the rotatable tool guide cylinder 46 for facilitating precision angular orientation of the rotatable guide cylinder 46 to align the distal end 52 of the guide channel 48 with any of the drill apertures, e.g., drill aperture 26, 28. In FIGS. 9 and 10, the distal end 52 of the guide channel 48 is shown aligned with the drill aperture 26. In the example implementation of the angular positioning apparatus 50 illustrated in FIG. 9, a ratchet mechanism with a plurality of spaced-apart slanted ratchet teeth, for example, the teeth 135, 137 (plus several more that cannot be seen in the cross-section view of FIG. 9), protruding downwardly from the bottom end of the tool guide cylinder 46, and mating pawl teeth, for example pawl teeth 134, 136, 138, 140 (also visible in FIGS. 17 and 18), protruding upwardly from an axially slidable pawl hub 132 into the notches or spaces between the ratchet teeth 135, 137, et al. In their engaged position, as shown in FIGS. 9 and 10, the distal end 52 of the guide channel 48 is aligned with one of the drill apertures 26, 27, 28, 29, for example, with the drill aperture 26.

The pawl teeth 134, 136, 138, 140 have to be cammed under the ratchet teeth 135, 137 et al. and thereby become disengaged from the ratchet teeth 135, 137 et al. in order for the tool guide cylinder 46 to rotate about the longitudinal axis 11 while the housing sleeve 120 remains stationary, as will be described in more detail below. The leaf springs 30, 32, 34, 36 best seen in FIGS. 3*b* and 10 centralize the housing sleeve 120 in the casing 100, and the frictional engagement of the leaf springs 30, 32, 34, 36 with the inside surface of the casing 100, as best seen in FIG. 10, resists rotational movement of the housing sleeve 120 while the tool guide cylinder 46 is rotated to orient the guide channel 48 in the desired direction for the bit 22 of the drill tool 30 (FIG. 11), as will be explained in more detail below. The pawl hub 132 is movable downwardly against the spring force of the coil spring 142 in order to accommodate such disengagement of the pawl teeth 134, 136, 138, 140 from the ratchet teeth 135, 137, et al.

The pawl hub 132 and pawl teeth 134, 136, 138, 140 are prevented from rotating along with the tool guide cylinder 46 and ratchet teeth 135, 137 et al. inside the housing sleeve 120 by a dog clutch arrangement, wherein a plurality of dogs, for example, dogs 144, 146, 148, 150, protruding downwardly in the axial direction into a plurality of mating recesses 154, 156, 158, 160 in the bottom end plug 162, as best seen in FIG. 9 along with FIGS. 17 and 18. The end plug 162 is attached to the bottom end of the housing sleeve 120 by pipe threads 164, as best seen in FIG. 9, so it is not rotatable with respect to the housing sleeve 120, but the tool guide cylinder 46 is rotatable about the longitudinal axis 11 with respect to the end plug 162, inhibited only by the interfacing ratchet teeth 135, 137, et al. and pawl teeth 134, 136, 138, 140. The pawl hub 132 is mounted and held in place on the end plug 162 by a bolt 166, which extends through the central, axial hole 168 in the pawl hub 132 and is screwed into a threaded hole 170 in the end plug 162. These components in operation will be described in more detail below.

With continuing reference primarily to FIGS. 9 and 11, bushings 172 and 174 in the guide cylinder 46 at the distal end 52 of the guide channel 48 and in the housing sleeve 120 around the drill aperture 26, respectively, help to stabilize and guide the drill bit 22 as it cuts a hole through the casing 100. Similar bushings 176, 178, 180 are installed in the other drill apertures 27, 28, 29 in the housing sleeve 120, as shown in FIG. 10. As also best seen in FIG. 10 along with FIG. 3*b*, the leaf springs 30, 32, 34, 36 distributed around the outside of the housing sleeve 120 stabilize and hold the housing sleeve 120 in the center of the casing 100 during operation of the drill tool 20 (FIG. 11) to cut or drill holes through the casing 100. Shallow channels 194, 195, 196, 197 (FIG. 10) can be recessed into the outer surface of the housing sleeve 120 to provide extra room for the leaf springs 30, 32, 34, 36 to be constricted by the inside surface of the casing 100 as the boring tool positioning apparatus 10 is pushed into the casing 100.

Referring now primarily to FIG. 11, when the tool guide cylinder 46 is set with the distal end 52 of the guide channel 48 in alignment with the drill aperture 26, as shown in FIGS. 9 and 10, the drill tool 20 is lowered into the boring tool positioning apparatus 10 until the cutting tip of the drill bit 22 extends through the guide channel 48 and drill aperture 26 far enough to contact the inside surface of the casing 100, as shown in FIG. 11. In the example implementation illustrated in FIG. 11, the longitudinal axis of the drill bit 22 in that position against the inside surface of the casing 100, where it is poised to start cutting or drilling a hole through the casing 100, is substantially perpendicular to the longitudinal axis 11 of the boring tool positioning apparatus 10, although other orientations or angular relationships could also be used.

The example socket 116 and self-engaging nesting of the drill motor 20 in the example socket 116 is illustrated in FIGS. 11 and 21-23. The socket 116 comprises cylindrical body 240 with a longitudinal bore 242 extending through its longitudinal axis 11. A conically tapered entrance 244 leads downwardly to a larger diameter nesting bore 246, which extends downwardly to diametrically opposite spiral shoulders 248, 250 that spiral downwardly to respective diametrically opposite slots 252, 254. The arrows 256, 258 in FIG. 21 indicate the downward spiraling direction of the shoulders 248, 250. The first slot 252 extends longitudinally downward from the top, starting edge 260 of the shoulder 250 and from the lower terminal edge 262 of the spiral shoulder 248 toward the bottom of the body 240. The second slot 254 extends downwardly from the top, starting edge 264 of spiral shoulder 248 and from the lower terminal edge 266 of the spiral shoulder 250 toward the bottom of the body 240. Both of the vertical slots 252, 254 intersect and extend radially outward from the longitudinal bore 242. The spiral shoulders can optionally have a hollow cut profile, as visible, for example in the profiles of the edges 262, 264 in FIG. 22 and also optionally can have serrated glide surfaces 268, 270. The hollow cut profile and/or serrated surfaces decrease surface area of the contact with the drill motor 20 to reduce friction and enhance self-nesting of the drill motor 20 in the socket 116, as will be described below. When the socket 116 is installed on the top end of the tool guide cylinder 46, for example, by the pipe threads 118, the central bore 242 of the socket 116 aligns with the proximal end 51 of the guide channel 48.

Figure 21:
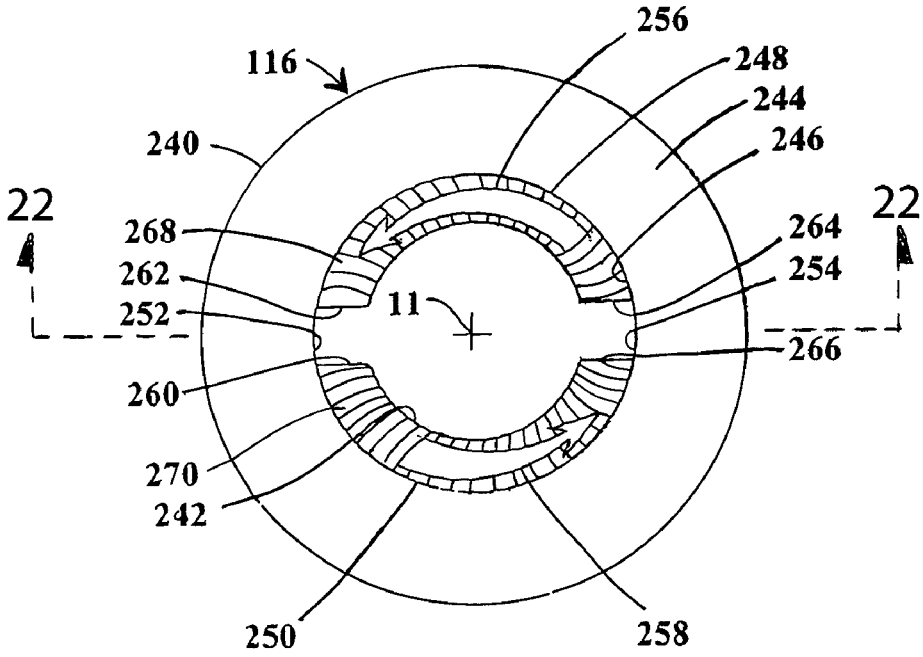
FIG. 21 is a top plan view of the socket that receives and secures the drill tool in the boring tool orienting assembly.
Figure 22:
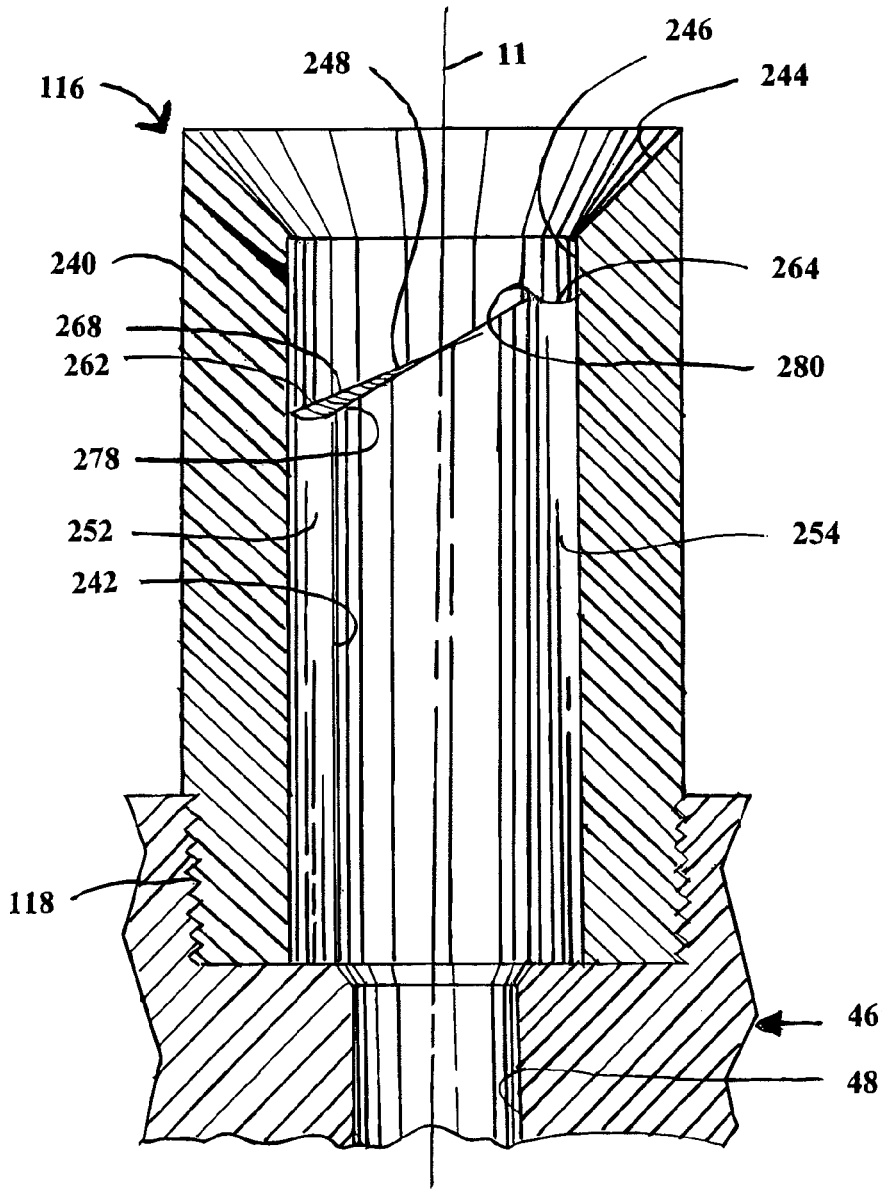
FIG. 22 is a cross-section view of the socket taken substantially along lines 22-22 in FIG. 21.
Figure 23:
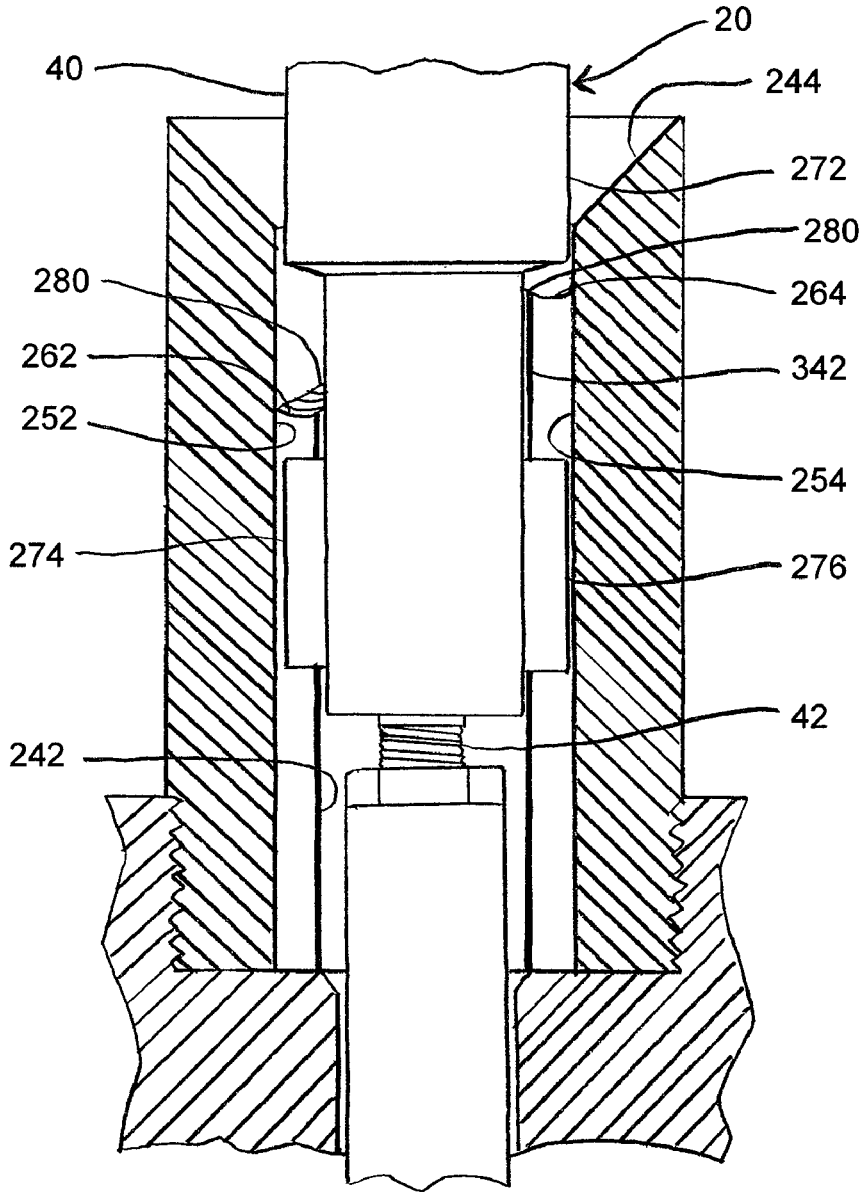
FIG. 23 is a cross-section view similar to FIG. 22, but showing the drill tool nested in the socket.
Figure 24:
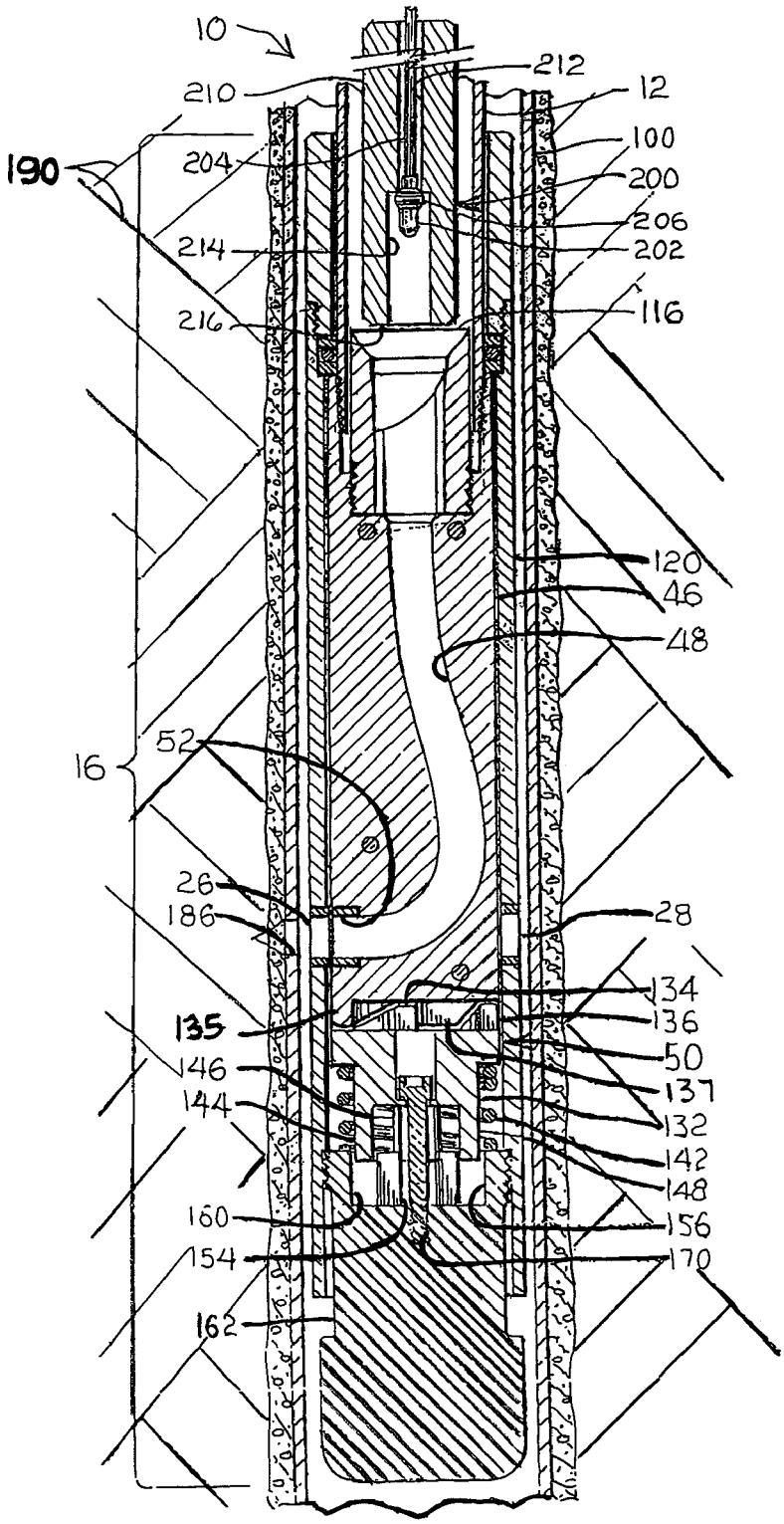
FIG. 24 is a cross-section view of the boring tool orienting assembly similar to FIG. 11, but with the high pressure water jet boring tool being installed into the boring tool orienting assembly.
Figure 25:
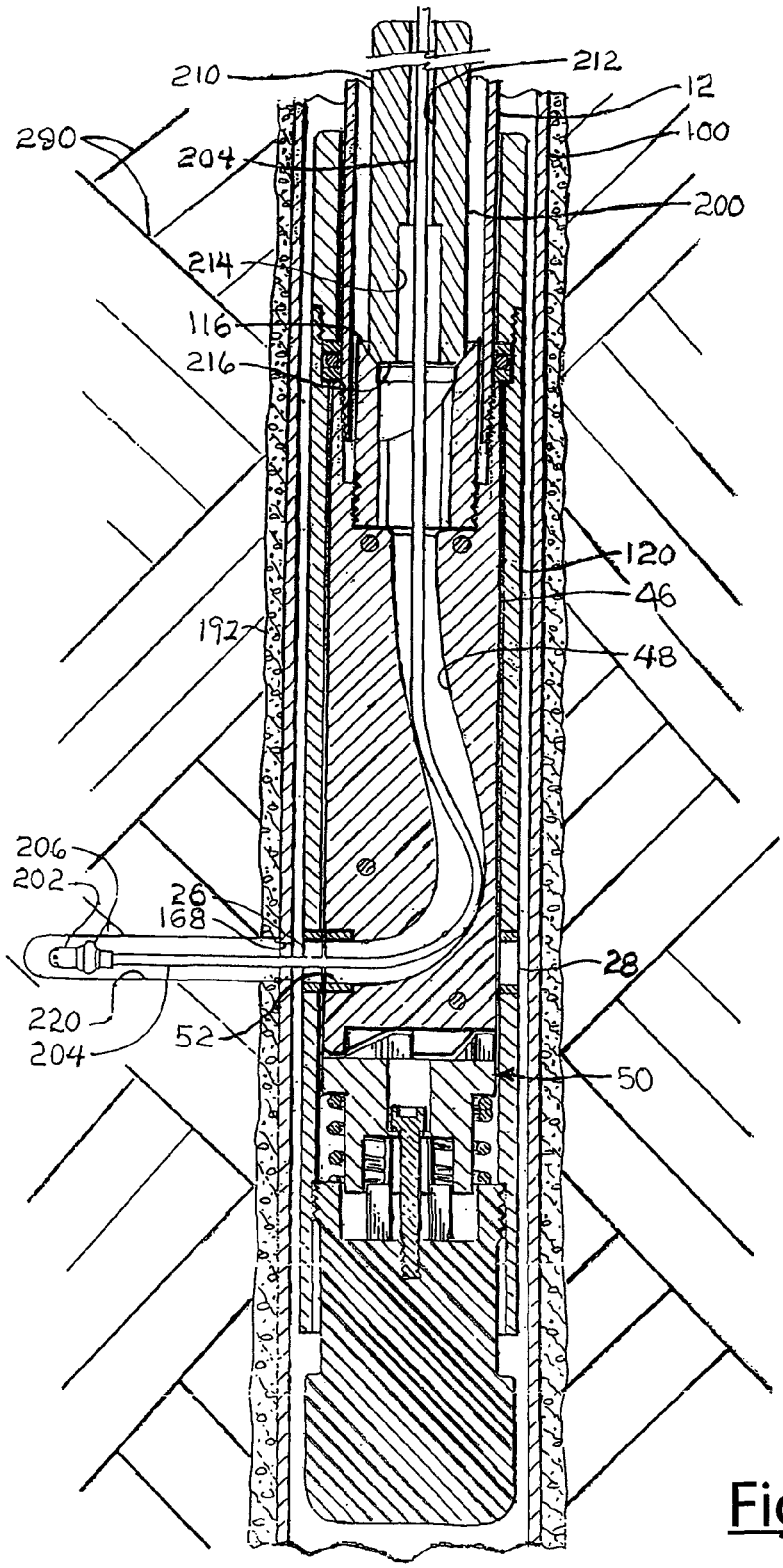
FIG. 25 is a cross-section view of the boring tool orienting assembly similar to FIG. 24, but with the high pressure water jet boring tool positioned in the boring tool orienting assembly and being used for boring a lateral channel into the reservoir formation.

Referring now primarily to FIG. 23, along with FIGS. 11 and 21-22, the drill motor 20 has a diameter that can fit into the nesting bore 246 and a drive shaft 42 that extends axially from a transmission housing 272. The transmission housing 272 is smaller in diameter than the drill motor body 40 and fits into the main bore 242. A pair of ears 274, 276 extend radially outward from the transmission housing and are sized to slip into the slots 252, 254. When the drill motor 20 is initially set into the socket 116, the cutter 22 and flexible shaft 24 lead the way through the main bore 242 and into the guide channel 48. When the bottom edges of the ears 274, 276 hit the spiral shoulders 248, 250, gravity and the weight of the drill motor 20 cause them to glide down the spiral shoulders 248, 250 as indicated by arrows 256, 258 in FIG. 21 to the respective lower edges 262, 264, where they drop into the slots 252, 254. The drill tool 20 will continue dropping downwardly until the cutter 22 hits the casing 100 (FIG. 11), as explained above. Then, as the cutter 22 cuts a hole 186 through the casing 100, the transmission housing 272 and ears 274, 276 (FIG. 23) can continue to move longitudinally downwardly in the socket 116, but the ears 274, 276 in the slots 252, 254 prevent rotational movement of the transmission housing 272 in the socket 116, and the bore 242 holds the transmission housing 272 snugly (not tightly) in the socket 116 to prevent excessive wobbling and other movement during the cutting operation.

As mentioned above, the hollow cuts on the top surfaces of the spiral shoulders 248, 250 leave sharp inside edges 278, 280 (FIG. 22) on which the bottom edge of the ears bear as they glide down the spiral shoulders 248, 250, which presents a very small surface contact area, thus reduced friction. As a result, the ears 274, 276, bearing the weight of the drill tool 20, glide easily and smoothly into the slots 252, 254 to set the drill tool firmly and securely into the socket 116. As also mentioned above, serrated grooves 268 can also reduce friction and enhance gliding of the ears 274, 276 down the spiral shoulders 248, 250 in to the slots 252, 254.

Figure 12:
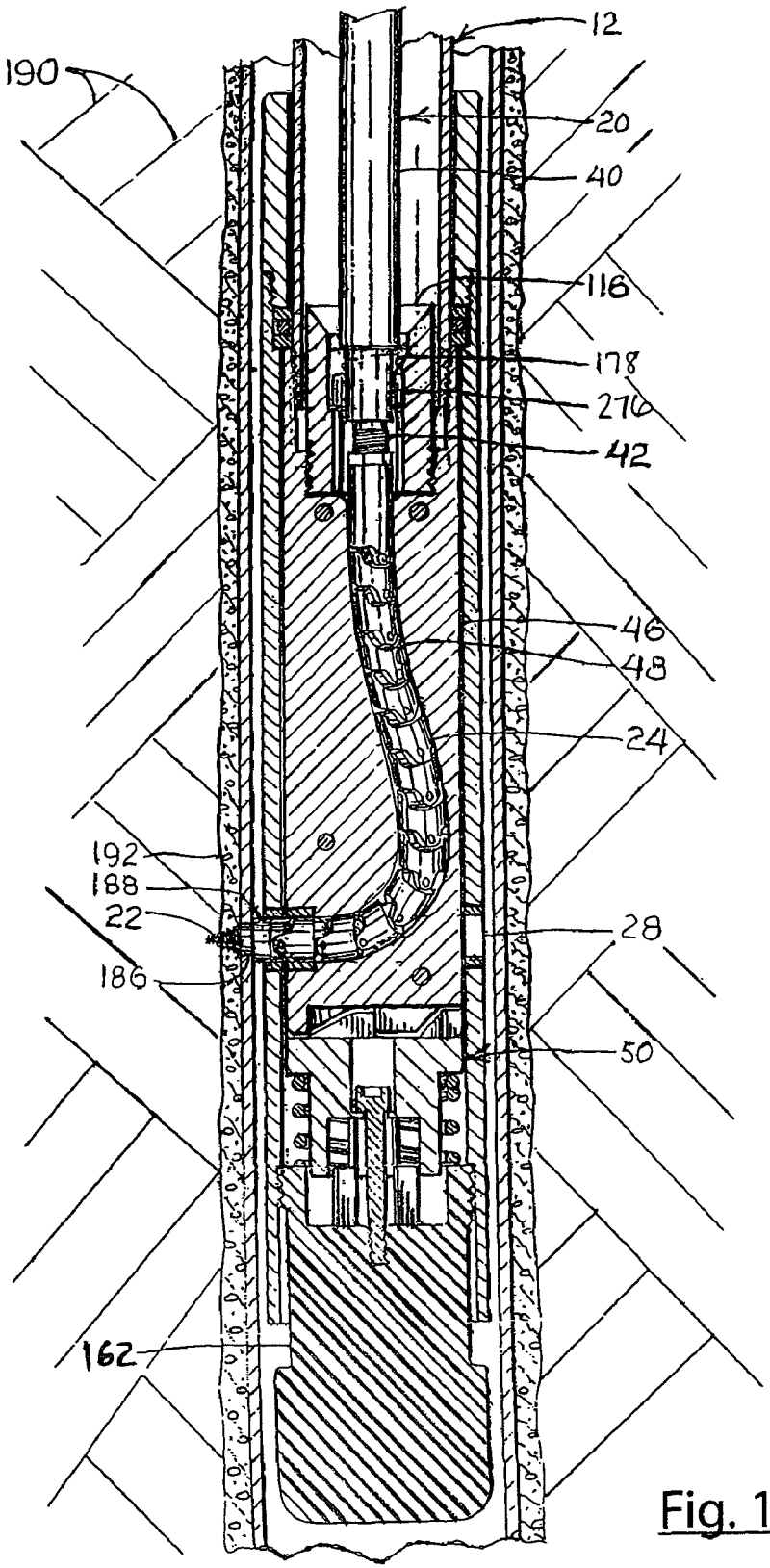
FIG. 12 is a cross-section view similar to FIG. 11, but showing the example drill tool position when the hole drilled through the well casing has been completed.

Hydraulic fluid, for example, drilling mud, water, or other fluid, can then be pumped down the well though the tube or hose 44 (FIG. 2) to power the hydraulic motor 40 to rotate the flexible shaft 24 and drill cutter or bit 22. The weight of the hydraulic motor 40 maintains pressure on the drill bit 22 while it cuts a hole through the casing 100, and a key tab 182 at the bottom of the hydraulic motor 40 interacts with a spiral keyway 184 in the socket 116 to prevent the hydraulic motor 40 from turning instead of the flexible shaft 48 and drill bit 22. As the drill bit 22 cuts and advances through the casing 100, the lower end of the hydraulic motor 40, including the drive shaft 42, continues to sink lower into the socket 116, as shown in FIG. 12. As the drill bit 22 cuts a hole 186 through the casing 100, a collar 188 with a larger diameter than the bit 22 advances to abut against the casing 100 around the new hole 186 to stop any further advance of the bit 22 and flexible shaft 48 into the reservoir formation 190.

Figure 13:
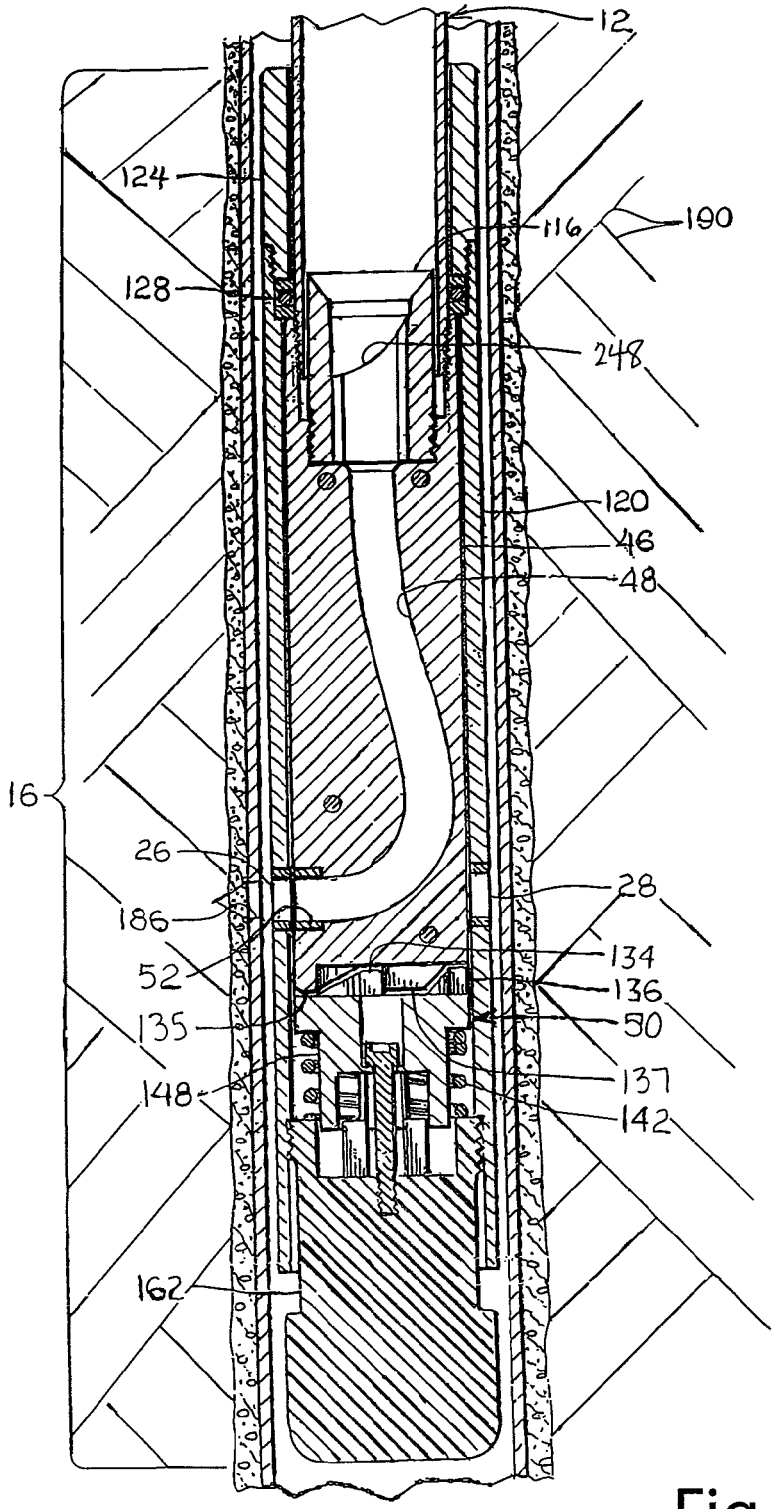
FIG. 13 is a cross-section view similar to FIG. 12, but with the drill tool removed from the boring tool orienting assembly and showing the completed hole drilled through the well casing.

After the hole 186 has been drilled through the casing 100, as shown in FIG. 12, the drill tool 20 is then pulled upwardly to pull the drill bit 22 back out of the newly drilled hole 186 in the casing 100 and out of the drill aperture 26 so that the tool guide cylinder 46 can be reoriented to re-align the distal end 52 of the guide channel 48 with another drill aperture, for example, the next drill aperture 27, in the housing sleeve 120 (FIG. 16), in order to set up for drilling another hole through the casing 100 in a different direction. While it is only necessary to pull the drill tool 20 upwardly enough to pull the hydraulic motor 40, flexible shaft 24, and drill bit 22 back out of the new hole 168 and the drill aperture 26 in order to rotate the tool guide cylinder 46, in practice, it may be more practical to pull the drill tool 20 with its flexible shaft 24 and bit 22 all the way out of the boring tool orienting assembly 16, as shown in FIG. 13, and suspend it higher in the carrier pipe 12 or in the upset/production tubing 112 (FIGS. 1-8) during the time that the tool guide cylinder 46 is rotated to a new orientation, as will be described below. The first newly drilled hole 186 in the casing 100 and extending slightly into the cement 192 is shown in FIG. 13.

With the drill tool 20 pulled up at least enough to withdraw the drill bit 22 from the newly drilled hole 186 and first drill aperture 26, as shown in FIG. 13, the tool guide cylinder 46 can be rotated to a new tool orientation, for example, to align the distal end 52 of the guide channel 48 with the next drill aperture 27 (FIG. 16), which, in the example being described, is oriented at about a 90 degree angle from the first drill aperture 26. To do so, the operator can rotate the upset/production tubing string 112 (FIGS. 6-8) clockwise in order to rotate the carrier pipe 12 and tool guide cylinder 46 clockwise, as illustrated, for example, in FIG. 14, which shows the tool guide cylinder 46 rotated through an angle of about 45 degrees from the first drill aperture 26. It is also helpful to look at FIG. 16 along with FIG. 14 for this explanation. Note that, because of the angular orientation of the cross-section view in FIG. 14, the leaf springs 30, 32, 34, 46 around the outside of the housing sleeve 120 are not visible in FIG. 14, but they can be viewed in FIGS. 10 and 16, where they are shown maintaining the tool orienting assembly 16 in the center of the casing 100 while they also create frictional engagement with the inside surface of the casing 100 to resist rotation of the housing sleeve 120 as the carrier pipe 12 and tool orienting cylinder 46 are rotated to new positions.

In FIG. 14, the tool guide cylinder 46 is shown rotated about 45 degrees from the initial position where the first hole 186 was drilled through the casing 100, which, in the example illustrated, is about one-half of the angular rotation required to re-align the distal end of the guide channel 48 with the next drill aperture 27 in the housing sleeve 120. The angular positioning apparatus 50 at this angular position shows the coil spring 142 depressed by the pawl hub 132 enough to allow the ratchet teeth 135, 137, 139, 141 on the bottom of the tool guide cylinder 46 to slide over and past the adjacent pawl teeth 134, 136, 138, 140 in order rotate the tool guide cylinder 46 to the new orientation. Of course, not all of the ratchet teeth 135, 137, 139, 141 and not all of the pawl teeth 134, 136, 138, 140 can be seen in FIG. 14, because FIG. 14 is a cross-section that shows only half of the structure. However, persons skilled in the art can understand the information provided by the representative ratchet teeth and pawl teeth that can be seen in FIG. 14.

When the carrier pipe 12 is rotated, for example, the 45 degrees clockwise illustrated in FIG. 14, the tool guide cylinder 46 also gets rotated simultaneously by the same amount, because the tool guide cylinder 46 is attached rigidly, for example by pipe threads 122, to the carrier pipe 12. However, because the housing sleeve 120 is supported by the shoulder sleeve 124 on the thrust bearing 128 (FIG. 14) and constrained from rotation by the leaf springs 30, 32, 34, 36 (FIG. 16), the housing sleeve 120 remains stationary, while the carrier pipe 12 and tool guide cylinder 46 are rotated. Also, the carrier pipe 12 and tool guide cylinder 46 are constrained against upward movement by the weight of the upset/production tubing string 112 (FIGS. 6-8). Therefore, as the tool guide cylinder 46 is rotated, the slanted ratchet teeth 135, 137, 139, 141 on the bottom of the tool guide cylinder 46 interact with the slanted pawl teeth 134, 136, 138, 140 on the pawl hub 132 to push the pawl teeth 134, 136, 138, 140 and pawl hub 132 downwardly against the force of the coil spring 142 so that the ratchet teeth 135, 137, 139, 141 can slide over the tops of the pawl teeth 134, 136, 138, 140. The recesses 154, 156, 158, 160 in the end plug 162 are deep enough for the dogs 144, 146, 148, 150 on the bottom of the pawl hub 132 to move farther downwardly into the recesses 154, 156, 158, 160 to thereby accommodate the axially downward movement of pawl hub 132 that is necessary for the ratchet teeth 135, 137, 139, 141 to slide over the tops of the pawl teeth 134, 136, 138, 140, as illustrated in FIG. 14.

Figure 15:
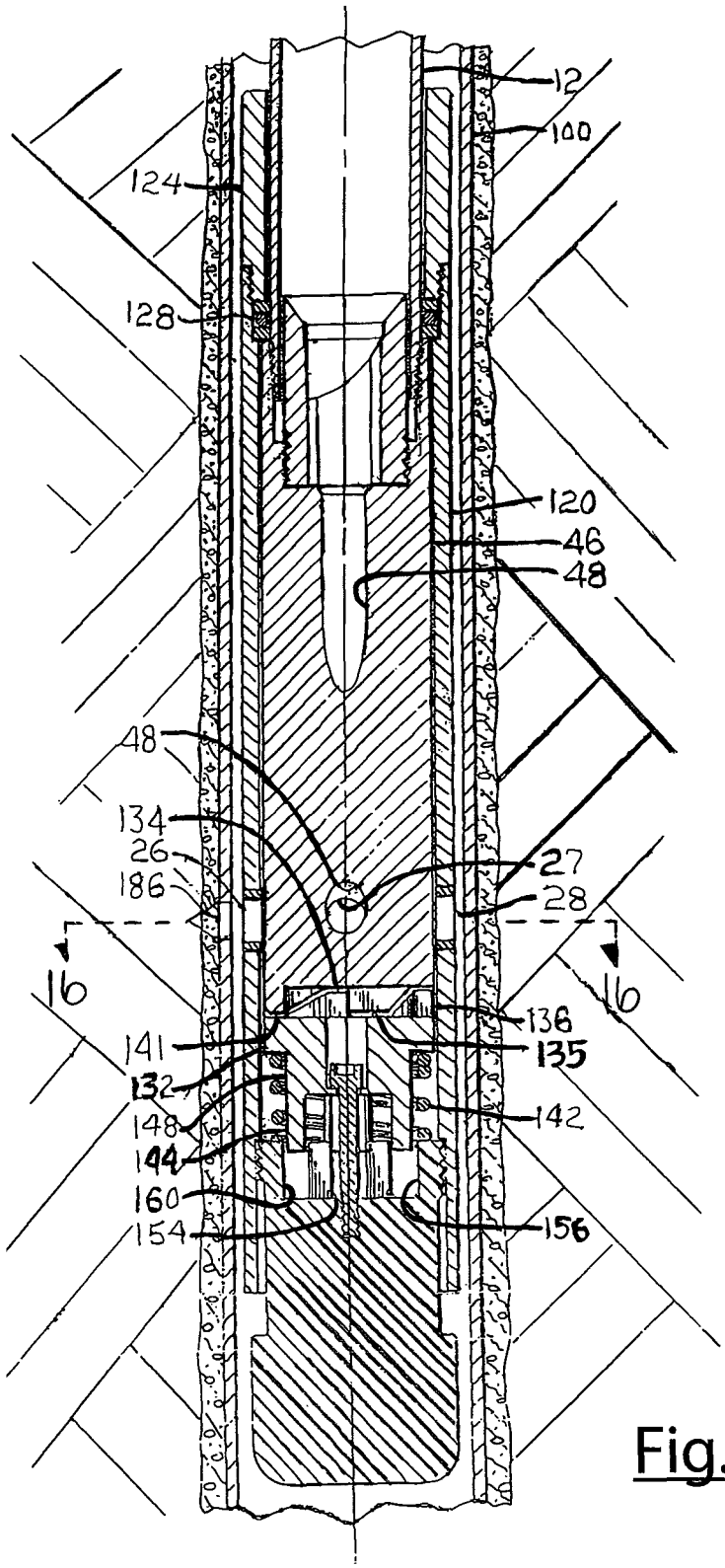
FIG. 15 is a cross-section view similar to FIG. 13, but with the tool guide cylinder rotated about 90 degrees to the next successive drill aperture.
Figure 16:
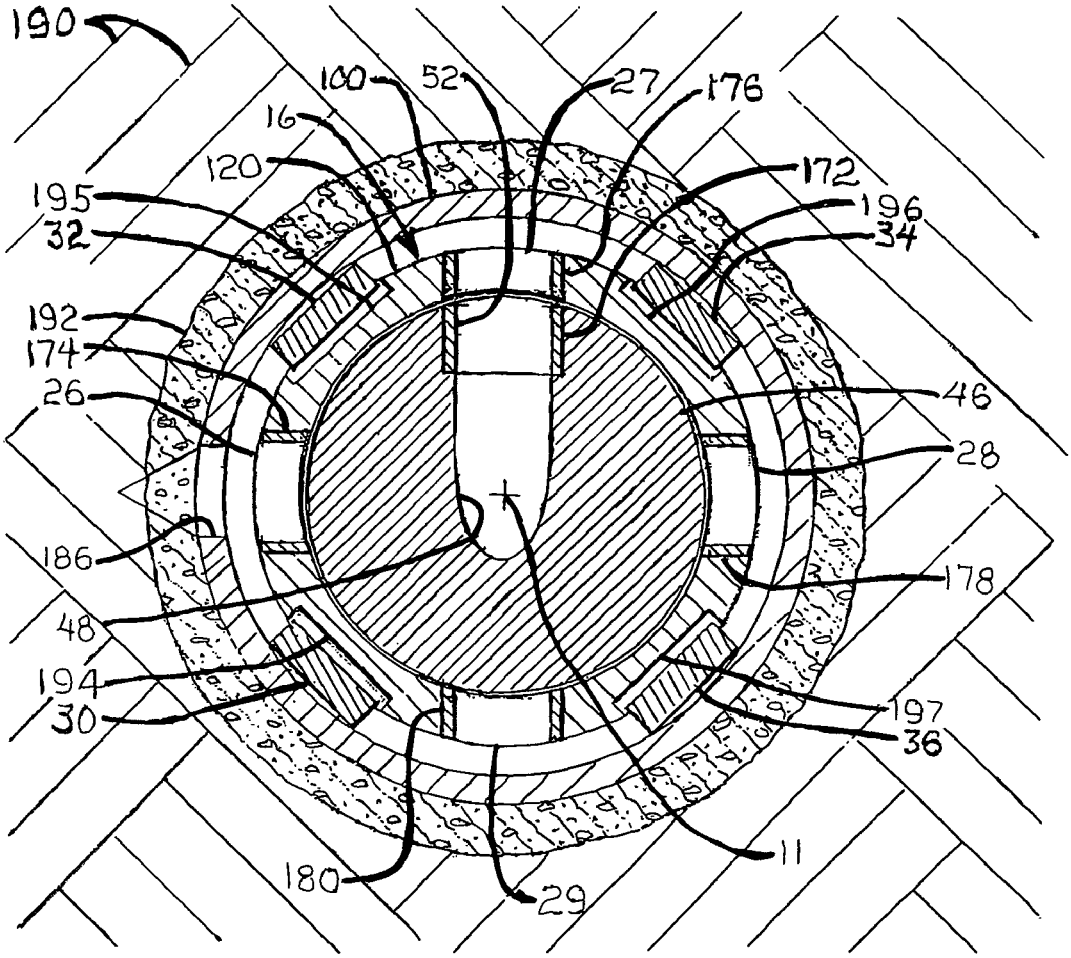
FIG. 16 is a transverse cross-section view of the boring tool orienting assembly of the example boring tool positioning apparatus in the well casing taken along section line 16-16 in FIG. 15.

As soon as the tool guide cylinder 46 is rotated enough for the ratchet teeth 135, 137, 139, 141 to clear the tops of the pawl teeth 134, 136, 138, 140, the force of the spring 142 snaps the pawl hub 132 back upwardly to seat the pawl teeth 134, 136, 138, 140 in the notches or spaces between the ratchet teeth 135, 137, 139, 141 and vice versa. The ratchet teeth 135, 137, 139, 141 and pawl teeth 134, 136, 138, 140 are sized and positioned in such a manner that such snapping of the pawl hub 132 upwardly to seat the pawl teeth 134, 136, 138, 140 in the notches between the ratchet teeth 135, 137, 139, 141 and vice versa occurs when the distal end 52 of the guide channel 48 is rotated into alignment with the next drill aperture 27 in the housing sleeve 120, as illustrated in FIGS. 15 and 16.

Once the tool guide cylinder 46 is set with its distal end 52 in alignment with the second drill aperture 27, then the drill tool 20 can be lowered back into the tool guide cylinder 46 to drill a second hole (not shown) in the casing through the second drill aperture 27 in the same manner as described above for drilling the first hole 186 through the first drill aperture 26. Then, the angular reorientation, realign, drill, remove, and rotate procedures as described above can be performed in sequence until all of the desired holes are drilled in the casing 100, for example, through the drill apertures 28 and 29, too. Of course, the angular rotation between successive drill apertures can be something other than the 90 degrees described in the example above, as long as the number and sizes of ratchet teeth and pawl teeth are made to match whatever number and angular orientation of drill apertures are desired. For example, if six drill apertures are spaced at thirty degrees intervals around the housing sleeve 120, then six ratchet teeth and six pawl teeth sized and spaced to allow just thirty degrees rotation between each successive set and re-set of the ratchet and pawl assembly would be needed.

Figure 19:
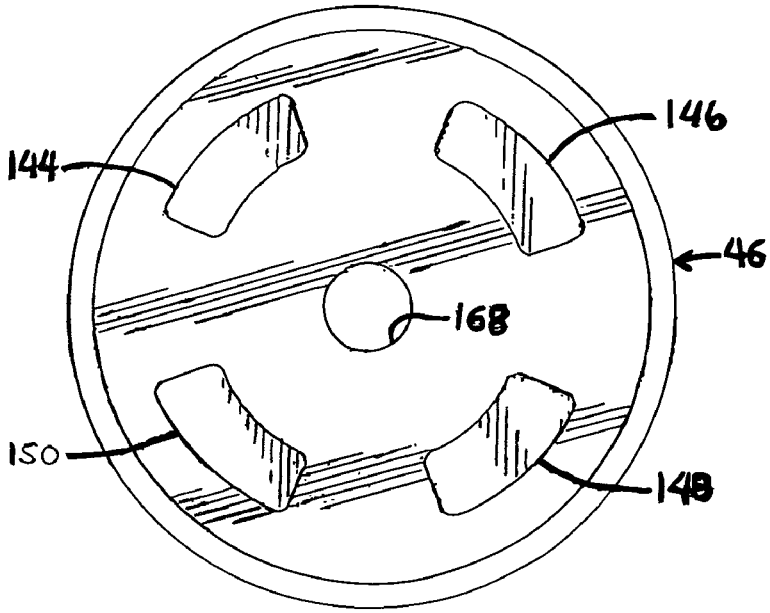
FIG. 19 is a bottom plan view of the pawl hub of the example angular positioning apparatus for the example boring tool positioning apparatus.
Figure 20:
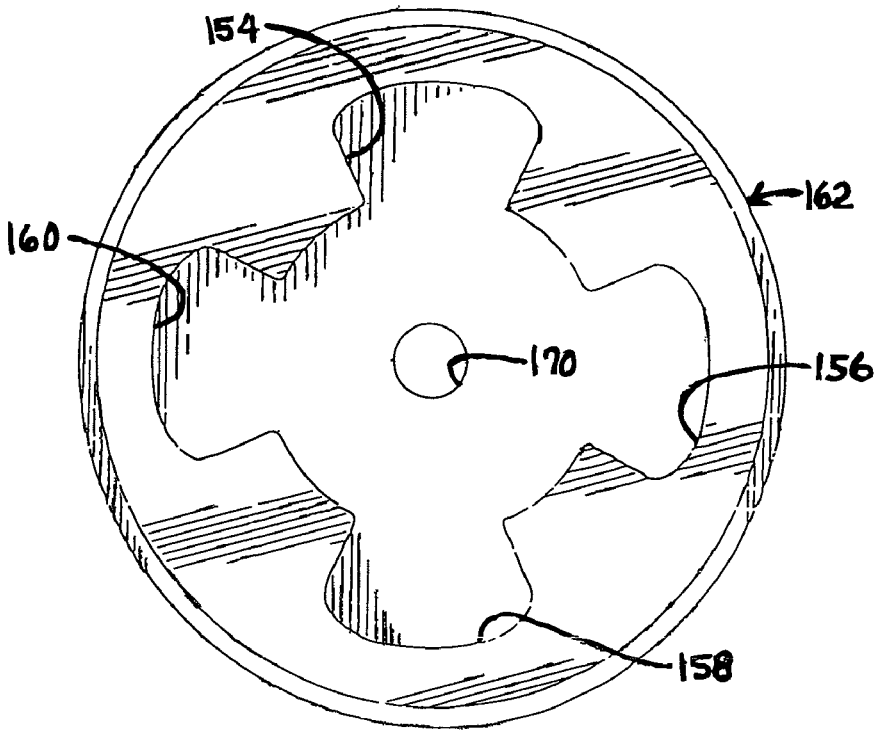
FIG. 20 is a top plan view of the end plug recesses for receiving the dogs of the pawl hub of the example angular positioning apparatus.

Once all of the desired holes are drilled through the casing 100, the drill tool 20 can be pulled out of the well and replaced by a high pressure water jet boring tool 200 for boring the holes farther outward from the casing 100 into the formation 190, as illustrated, for example, in FIGS. 19 and 20. The example water jet boring tool 200 is illustrated in FIG. 19 as it is being lowered from the ground surface through the upset/production tubing string (not shown in FIG. 19) and carrier pipe 12 into the boring tool orienting assembly 16, just before seating in the socket 116. Throughout these operations, e.g., drilling a plurality of holes 186 et al. through the casing 100, removing the drill tool 20, and replacing it with the high pressure jet boring tool 200, the housing sleeve 120 has not changed its position with respect to the casing 100, because the vertical anchor provided for the carrier pipe 12 by the wedge subassembly 80 described above (FIGS. 6-8) has not been released, and the leaf springs 30, 32, 34, 36 (FIGS. 10 and 16) have not allowed rotational movement of the housing sleeve 46 with respect to the casing 100. Consequently, the drill apertures 26, 27, 28, 29 in the housing sleeve 120 remain adjacent and in alignment with the respective holes 186, et al., in the casing 100 that were drilled through those drill apertures 26, 27, 28, 29, as described above. Therefore, the high pressure nozzle 202 of the high pressure water jet boring tool 200 can access the formation 190 through the same drill apertures 26, 27, 28, 29 and the respectively drilled holes 168, et al., in the casing 100 via the boring tool orienting assembly 16 by sequentially rotating the tool guide cylinder 46 to align the distal end 52 of the guide channel 48 sequentially with each of the drill apertures 26, 27, 28, 29. Also, because the dogs 144, 146, 148, 150 of the pawl hub 132 positioned in the recessed cavities 154, 156, 158, 160 prevent rotation of the pawl hub 132 with respect to the housing sleeve 120, thus also with respect to the drill apertures 26, 27, 28, 29, the angular positioning apparatus 50 described above also enables the operator to use the tool guide cylinder 46 to re-access and direct the blasting nozzle 202 of the high pressure water jet boring tool 200 through the drill apertures 26, 27, 28, 29 into the reservoir formation 190 in the same manner as described above for the drill tool 20.

Other angular positioning apparatus may also be used in the boring tool orienting assembly 16 instead of the ratchet and pawl apparatus discussed above. For example, one or more spring-loaded steel ball(s) (not shown) positioned between the bottom end of the tool guide cylinder 46 and the end plug 162 and associated detent holes (not shown) positioned in either the bottom of the tool guide cylinder 46 or the top of the end plug 162 and positioned angularly to align the distal end 52 of the guide channel 48 with the respective drill apertures 26, 27, 28, 29 when the ball(s) are seated in the detent(s) could also be used.

The example water jet boring tool 200 shown in FIGS. 19 and 20 comprises the high pressure nozzle 202, sometimes called a jet nozzle or blaster nozzle mounted on the end of a high pressure hose or tube 204, for example, a metallic tube used in conventional coil tubing units used in the oil and gas industry to direct a high pressure jet or blast of water or other liquid or gas, such as air or nitrogen, into wells for clearing operations or into rock or other formation material in oil wells. The terms high pressure jet or blaster are common terms that refer to high pressure ejection of fluids, i.e., liquids or gases, for various cutting, cleaning, or other purposes, where pressures in the range of several thousand to over ten thousand pounds per square inch (psi) are involved. Therefore, for convenience, the general term "blaster tube" is used herein for the conduit 204, which is not intended to exclude high pressure hose or other materials that can be used in the apparatus and method described herein, but it does provide a convenient terminology to avoid confusion with the upset/production tubing string 112, which is mentioned above and may also be included in explanations or descriptions relating to oil and gas well applications for the described apparatus and methods.

An optional traveling block 210 can be used to house and protect the nozzle 202 during descent of the nozzle 202 into the well, and, the added weight of the traveling block 210 on the distal end of the blaster tube 204 can help to lead and guide the tube 204 and nozzle 202 down the upset/production tubing string 112 (not shown in FIG. 19) to the boring tool positioning apparatus 10. Therefore, the traveling block 210 can comprise an elongated, heavy metal body with a longitudinal hole 210 through its length with a diameter large enough for the blaster tube 204 to pass or slide through unimpeded. A retainer ring 206 or other device with a diameter or other transverse dimension larger than the diameter of the hole 212 can be included, if necessary, in the nozzle 202 components or otherwise provided at or near the distal end of the blaster tube 212 to retain the traveling block 210 on the blaster tube 204 as it is lowered into the upset/production tubing string 112 or as it is pulled out of the upset/production tubing string 112. Of course, such a retainer ring 206 may not be necessary is the nozzle 202 itself or fittings that fasten the nozzle 202 to the blaster hose 204 are large enough to prevent the traveling block 210 from slipping off the blaster hose 204. However, the nozzle 202 has to be small enough in diameter to pass unimpeded through the holes 186 that were drilled through the casing 100 as described above in order to move through the holes 186 into the formation 190. A nesting cavity 214 can be recessed into the distal end 216 of the traveling block 210 with a diameter large enough to receive the nozzle 202 (and retainer ring 206 if included) for protection of the nozzle 202 on its descent through the upset/production tubing string 112 (not shown in FIG. 19) to the boring tool positioning apparatus 10.

The traveling block 210 with the nozzle 202 nestled in the nesting cavity 214 is shown in FIG. 19 just as it is has been lowered from the upset/production tubing string 112 (shown in FIGS. 6-8, but not visible in FIG. 19) into the carrier pipe 12 of the boring tool positioning apparatus 10 and is approaching the socket 116 of the boring tool orienting assembly 16 of the boring tool positioning apparatus 10. As also illustrated in FIG. 19, the tool guide cylinder 46 is rotated into a position where the distal end 52 of the guide channel 48 is aligned with a hole 186 that has been drilled through the casing 100 as described above. While it can be aligned with any of the holes 186 drilled through the casing 100, as a practical matter, it will probably be the last hole 186 drilled through the casing 100 before the drill tool 20 was removed, because the tool guide cylinder 46 will most likely still be set in that position when the blaster tube 204 and nozzle 202 are first lowered into the boring tool positioning apparatus 10.

Upon reaching the boring tool orienting assembly 16, the blasting tube 204 is lowered so that the distal end 216 of the traveling block 210 reaches and sits or nests on the socket 116, where it stays. However, as also shown in FIG. 20, the blaster tube 204 and nozzle 202 continue to be lowered and/or pushed through the socket 116 and guide channel 48 of the tool guide cylinder 46 and through the drill aperture 26 and hole 186 in the casing 100 to the cement 192 and/or reservoir formation 190. High pressure fluid, for example, water at a pressure in the range of 2,000 to 12,000 psi or more is then delivered through the blaster tube 204 and jetted through the nozzle 202 into the reservoir formation 190 to jet bore a lateral channel 220 extending generally radially outward from the casing 100. The length of the lateral channel 220 is optional, but it can be bored to extend hundreds of feet, if desired, from the casing 100 into the reservoir formation 190.

When the desired lateral channel 220 has been bored, the blaster tube 204 and nozzle 202 is pulled back out of the lateral channel 220 and out of the tool guide cylinder 46 so that the tool guide cylinder 46 can be rotated, as described above, to re-align the distal end 52 of the guide channel 48 with another drill aperture 26, 27, 28, or 29 and corresponding hole 186 that has been drilled through the casing as described above. When the guide channel 48 is so re-aligned to another hole 186 through the casing 100, the blaster tube 204 and nozzle 202 are then re-inserted through the guide channel 48 and aligned drill aperture 26, 27, 28, or 29 and hole 186 to the formation 190, and another lateral channel 220 is jet blasted with the nozzle 202 into the formation 190. This process is repeated for any or all of the holes 186 that were drilled through the casing 100, and, when completed, the blaster tube 204 is pulled out of the boring tool positioning apparatus 10 and back to the surface. Then, the boring tool positioning apparatus 10 can be released from its anchored position in the casing 100, as described above, and pulled out of the well.

Figure 26:
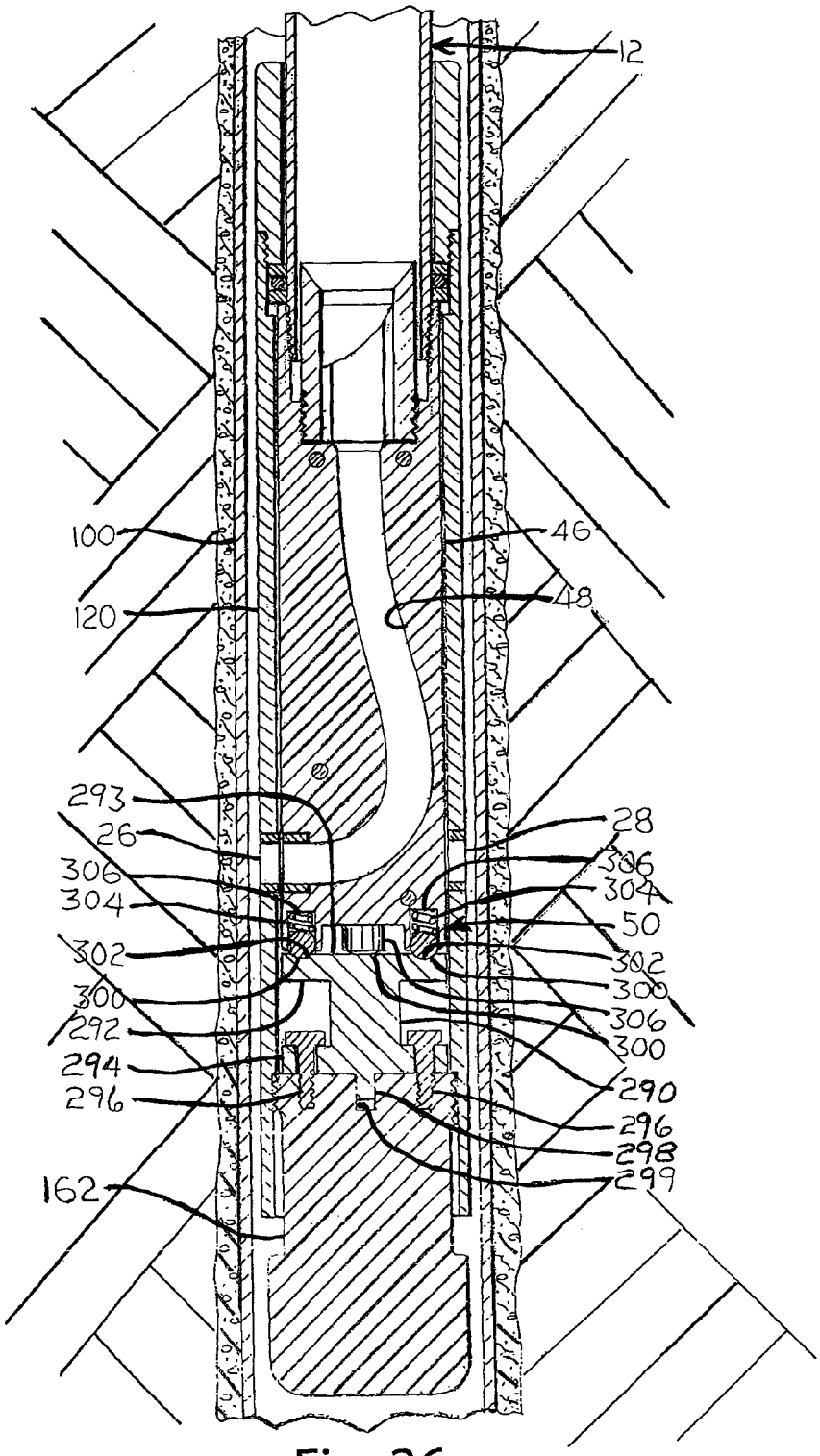
FIG. 26 is a cross-sectional view of an embodiment of the boring tool orienting assembly.

Another example of an angular positioning apparatus 50' is illustrated in FIG. 26. In this example, a plurality of hard balls 300, e.g., stainless steel, which are captured and spring-loaded by compression springs 304 in cylindrical container holes 306 in the bottom of the tool guide cylinder 46, interact with detent holes 302 in the top surface of a platform 290 attached to the plug 162. As explained above, the plug 162 is screwed into the bottom end of the housing sleeve 120, which is held immovable in relation to the well casing 100 by a plurality of leaf springs 30, 32, 34, 36 (not seen in FIG. 26 because of the view orientation), so the plug 162 and the platform 190, which is screwed tightly to the plug 162 by bolts 296, is also immovable with respect to the housing sleeve 120 and well casing 100.

Therefore, when the tool guide cylinder 46 is rotated by the carrier pipe 12 to reorient the guide channel 48 to align with a different drill aperture, for example, from drill aperture 26 to the next drill aperture 27 (not seen in FIG. 26), the balls 300 are forced against the force of springs 304 upwardly and out of the detent holes 302. As the tool guide cylinder 46 continues to rotate, balls 300, captured by the cylindrical holes 306, roll over the top surface 293 of the top flange 292 of the platform 290 until they reach the next adjacent detent hole 302. Upon reaching the next adjacent detent holt 302, which occurs concurrently with the guide channel 48 coming into alignment with the next drill aperture, the balls 300, under the force of the springs 304, drop into the respective detent holes 300 in a snap-like action, which can be felt or detected through the drill pipe at the surface of the well and immediately provides a resistance to further rotation of the tool guide cylinder 46. Therefore, the operator at the well surface stops the rotation and the balls 300 and detent holes 302 self-align the guide channel 48 with the drill apertures both for boring holes through the casing and then again for insertion of the blaster nozzle 202 and tube 204 (not shown in FIG. 26) into the formation as described above. A centering pin 298 can be provided on the bottom of the platform 290 for insertion into a centering hole 299 in the plug 162 to assure alignment of the detent holes 302 with the balls 300 before the bolts 296 are tightened onto the bottom flange 294 of the platform 290.

Figure 27:
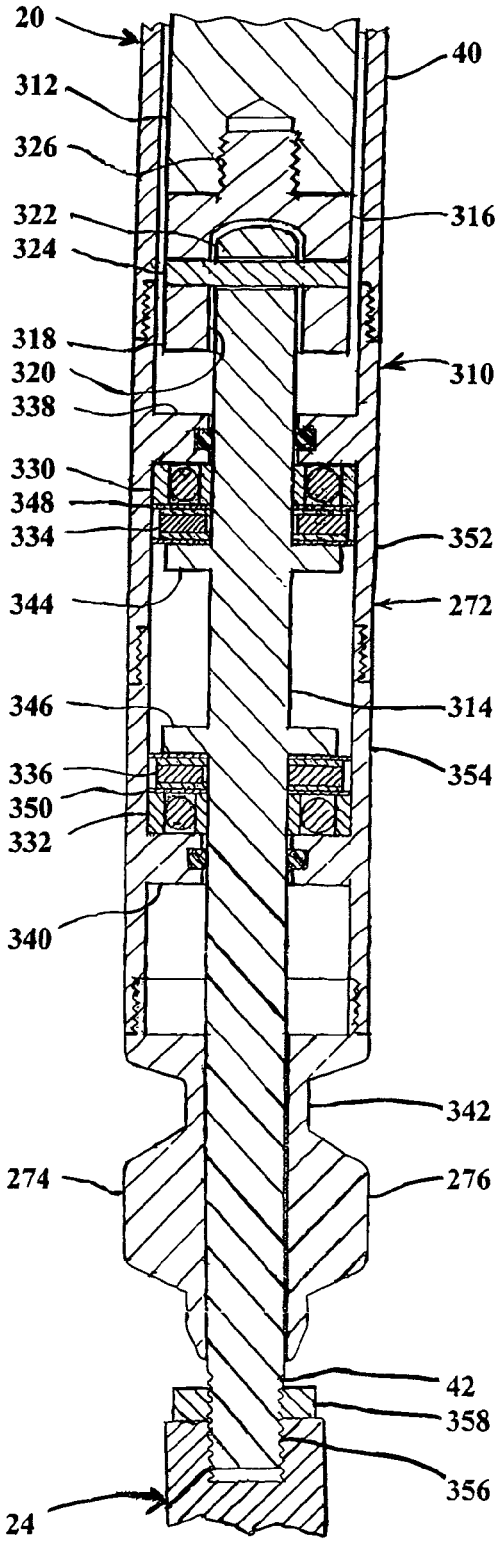
FIG. 27 is a cross-sectional view of an embodiment of a drive shaft coupling assembly.

An example drive shaft coupling assembly 310 is shown in FIG. 27 for coupling the flexible shaft 24 to the drive shaft 312 of the motor 40. A coupling shaft 314 is connected to the motor drive shaft 312 by a flexible joint 316 comprising a socket 318 with a bore 320, which receives the top end 322 of the coupling shaft 314, a pin 324 that extends through respective transverse holes in the socket 318 and coupling shaft 314 to transmit rotational movement of the motor drive shaft 312 to the coupling shaft 314, and a threaded boss 326 for fastening the joint 316 to the distal end of the motor drive shaft 312. The fit of the coupling shaft 314 on the pin 324 is preferably but not necessarily slidable, and in the fit of the coupling shaft 314 in the socket hole 320 is preferably, but not necessarily, slightly loose, to accommodate without transmitting some amount of wobble between the motor drive shaft 312 and the flexible shaft 24. Two sets of axial rotation bearings 330, 332 and thrust bearings 334, 336 bearing against respective annular shoulders 338, 340 of a bearing housing 272 and bearing on respective collars 344, 346 on the coupling shaft 314 maintain lateral stability of the coupling shaft 314 and isolate the motor drive shaft 312 from longitudinal loads transmitted between the drill tool 20 and the flexible shaft 24. Washers 348, 350 interface between respective rotational bearings 330, 332 and thrust bearings 334, 336. The bearing housing 272 is comprised of separate tubular sections 352, 354 threaded for screwing together to accommodate assemblage over the coupling shaft 314 and bearings as described above, and they are threaded for attachment respectively to the motor 40 on top and to the nose piece 342 on the bottom. The bottom or distal end 356 of the coupling shaft 314 is threaded for connection to the flexible shaft 24, and a lock nut 358 can be used to tighten the flexible shaft 24 to the coupling shaft 314 after adjustment in the threads to place the drill bit 22 (not seen in FIG. 27) at the proper position for effective boring through the wall casing 100 as explained above.

A slip joint 360, as shown for example in FIGS. 28-31, can be placed between the carrier pipe 12 and the well upset/production tubing 114 in order to accommodate elongation or shrinkage of the upset/production tubing string in the well due to temperature changes and other forces without forcing the boring tool positioning apparatus out of its anchored and set position in the casing during boring through the casing 100 and into the reservoir 290. The example slip joint 360 shown in FIG. 28 has a top sleeve 362 and an essentially identical bottom sleeve 364 in which a coupling tube 366 can slide longitudinally, although one such sleeve could be used. The top sleeve 362 is threaded and attached by screwing to the bottom of the upset/production tube 114, and the bottom sleeve 364 can be attached to the coupling 64 (not shown in FIG. 28) or to a tubing length or adapter 368, which can be screwed into the coupling 64, as will be understood by persons skilled in the art.

Figure 28:
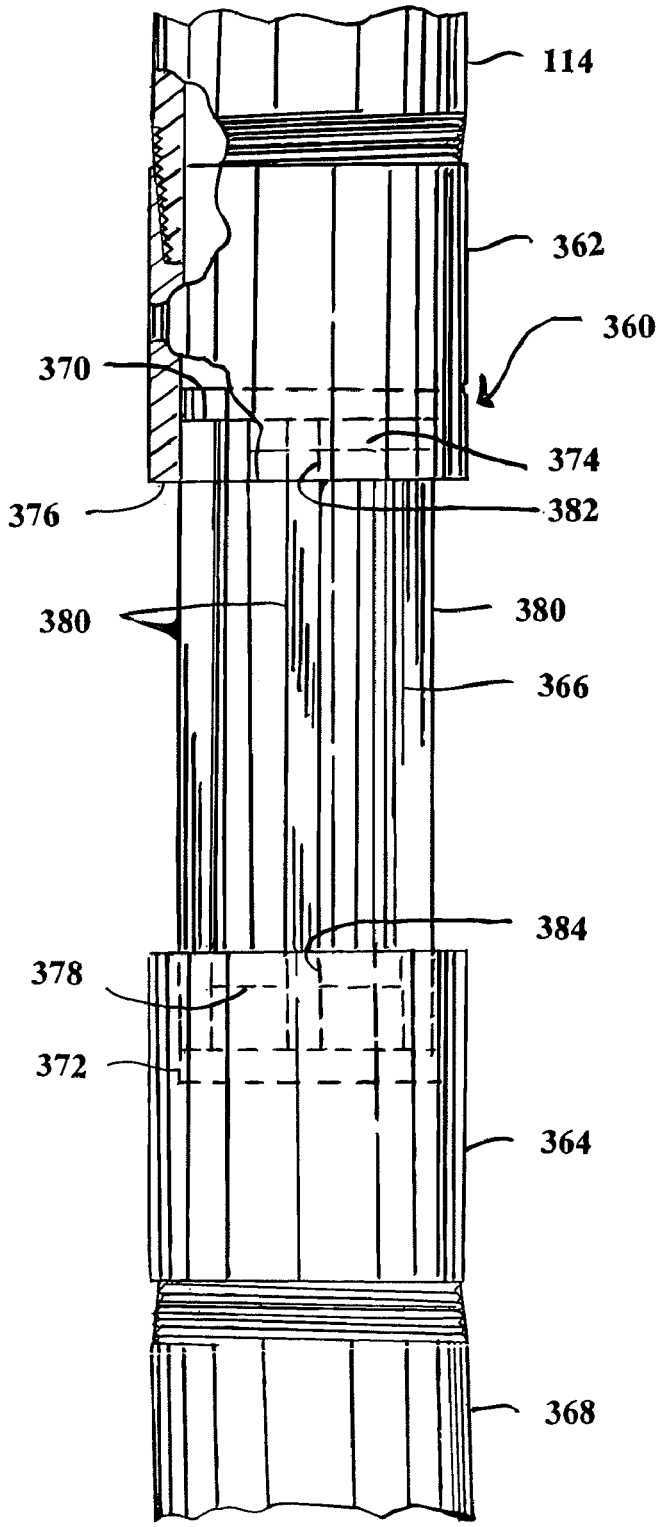
FIGS. 28 through 31 illustrate an embodiment of a slip joint.
Figure 29:
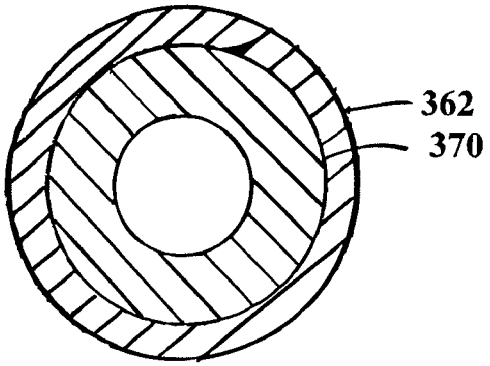
Figure 30:
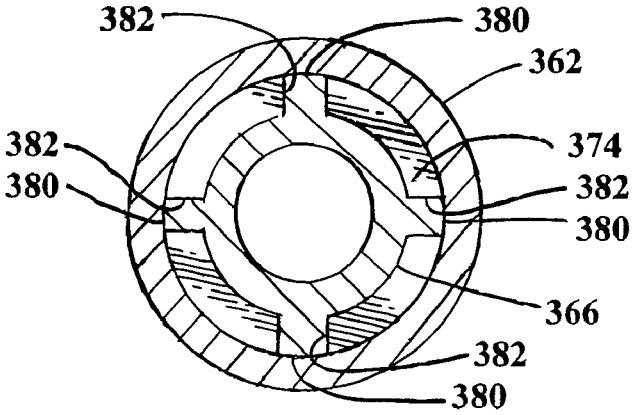
Figure 31:
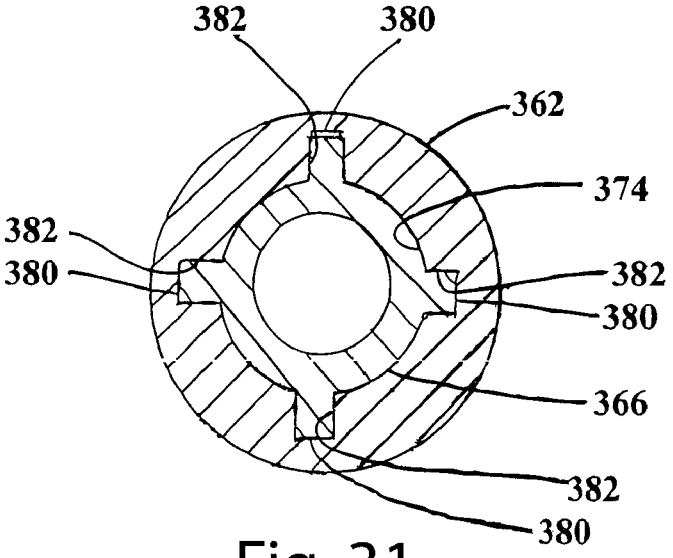

The coupling tube 366 has a flange 370 at its upper end and a similar flange 372 at its lower end, which fit slidably in the interiors of the upper and lower sleeves 370, 372, respectively, as shown in FIGS. 28 and 29. An annular shoulder 374 at the distal end 376 of the top sleeve 362 extends radially inwardly toward the coupling tube 366 to block the flange 370 from sliding out of the sleeve 362, but the flange 370 can slide up and down in the sleeve 362.

The coupling tube 366 is prohibited from rotating with respect to the sleeve 362 or vise versa by one or more splines 380 extending radially outward from the coupling tube 366, which slide longitudinally through mating slots 382 in the annular shoulder 374, while the annular shoulder 374 interfaces with the splines to prevent rotation. The bottom sleeve 364 also has a shoulder 378 that prevents the flange 372 at the bottom end of the coupling tube 366 from sliding out of the bottom sleeve 364, and it has similar slots 384 for allowing the splines 380 to slide into and out of the sleeve 364, while the shoulder 378 interfaces the splines 380 to prevent relative rotation between the coupling tube 380 and the lower sleeve 364.

Figure 32:
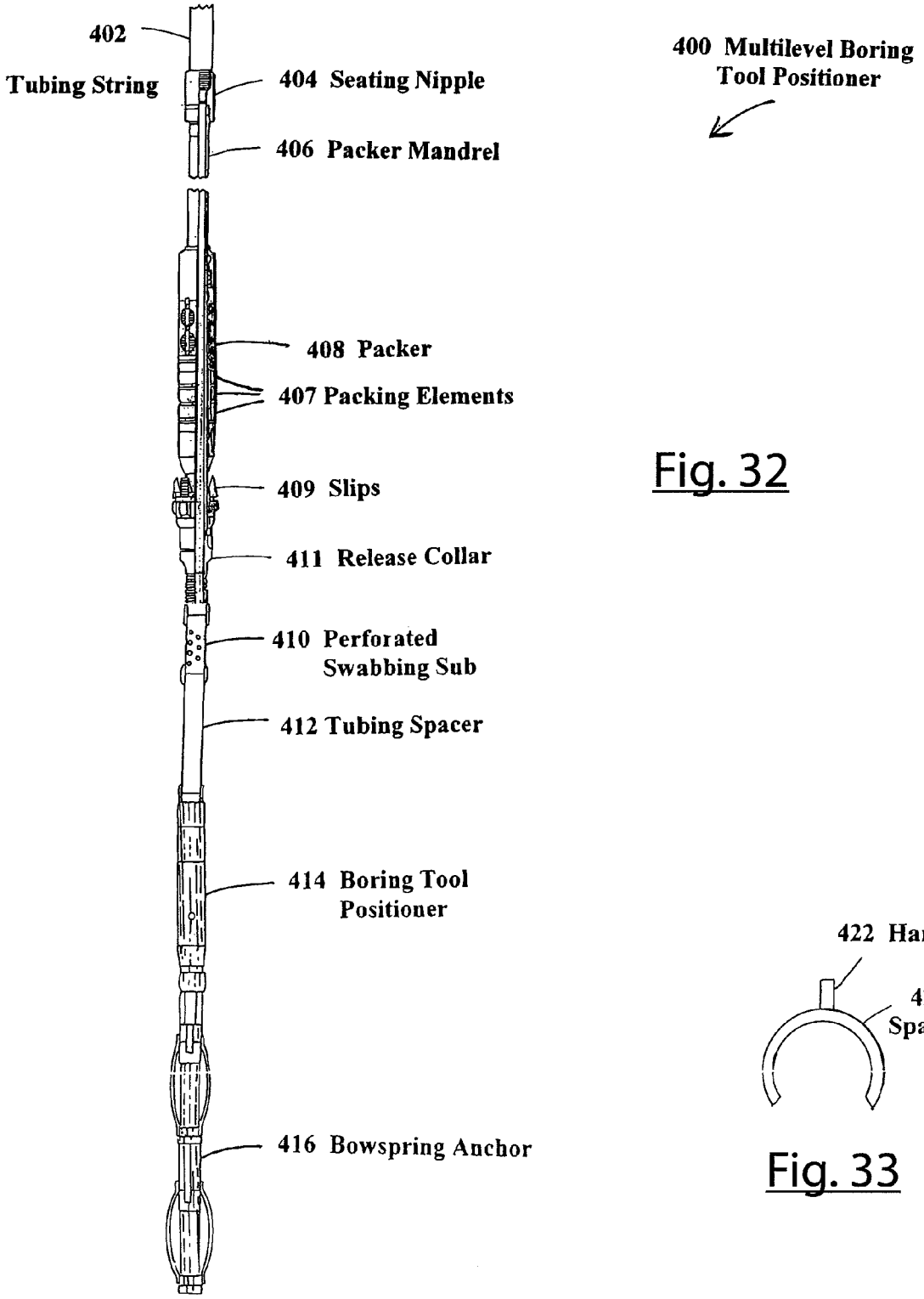
FIG. 32 illustrates an embodiment of a multi-level boring tool positioner.

FIG. 32 discloses a multi-level boring tool positioner 400. The multi-level boring tool positioner 400 comprises a seating nipple 404 that is attached to the tubing string 402. The seating nipple has a restricted inner diameter which provides a stop for the swab cups that are used to swab the tubing. The seating nipple 404 is connected to the packer mandrel 406. The packer mandrel comprises a standard mandrel that is similar to the mandrel that is supplied with the packer 408, which can be moved in a vertical direction through the packer 408 and rotated within the packer 408 to both set and release the packer 408. The packer 408 may comprise a Baker model R3 double grip retrievable casing packer, product no. 642-01, that is available from Baker Oil Tools, a division of Baker Hughes, 9100 Emmott Road, Houston, Tex. 77040-3596. The packer 408 is a setdown-type packer. The packer 408 is set by pulling up on the tubing string 402 until a release collar 411, that is connected to the bottom of the packer mandrel 406, engages the bottom of the packer. The tubing string 402 can then be rotated in a clockwise direction to close and seal the bypass valve when the release collar is allowed to disengage from the rocker slips 409. The setdown weight closes and seals the bypass valves, sets the slips and packs off the packing elements 407. To release the packer, the tubing string 402 can be raised so that the packer mandrel 406 slides through the packer 408 and causes the release collar to engage the bottom of the packer 408 and release slips 409. The bypass valve opens to permit circulation through and around the packer. The release collar 411 is shown in the upward released position in FIG. 32.

As also shown in FIG. 32, the release collar 411 is connected to the perforated swabbing sub 410. The perforated swabbing sub 410 has a plurality of holes that allow fluid between the casing (not shown in FIG. 32) and the perforated swabbing sub 410 to penetrate the openings and be swabbed from the interior of the tubing string 402. As illustrated in FIG. 32, the release collar 411 is in the upward release position so that the slips 409 and the packing elements 407 are not locked onto the casing of the well. In the operating position, the release collar is extended downwardly, and the packer mandrel 406 extends through the packer 408. Hence, in the operating position, the release collar 411 is separated by a distance from the slips 409 of the packer mandrel 406. Once the packer 408 is set, fluids from the bottom of the well cannot pass between the packer and the well casing.

As further shown in FIG. 32, tubing spacer 412 provides a vertical spacing between the packer 408 and the boring tool positioner 414. Down hole well loggers, such as gamma ray well loggers, can identify the location of a production zones of interest in the well. The packer 408 is located in the well so that the boring tool positioner 414 is positioned directly in the production zone of the well, as indicated by the well logger. The setdown procedure for setting the packer 408 may cause the boring tool positioner 414 to move downwardly by as much as approximately two feet. Hence, the packer 408 must be positioned properly to account for the setdown distance for setting the packer 408. The tubing spacer 412 allows the packer 408 to be positioned in a higher position in the well, so that the packer 408 can engage a clean, unperforated portion of the casing to set the packer 408. There have been instances when packers have been set in areas where the casing has been perforated, or has other problems, and the packer could not be released. Hence, the tubing spacer 412 provides spacing to allow the packer 408 to be secured in the hole in an area where the casing will allow the packer 408 to be cleanly secured to the casing so that the packer 408 can be easily released. The boring tool positioner 414 corresponds to any one of the various embodiments disclosed herein, such as the boring tool orienting assembly 16 disclosed above. Attached to the bottom of the boring tool positioner 414 is a bow spring anchor 416. The bow spring anchor 416 anchors and centers the boring tool positioner 414 in the casing.

In operation, the multi-level boring tool positioner 400, illustrated in FIG. 32, operates by pushing the entire assembly in the hole so that the boring tool positioner 414 is located in a lower portion of the production zone of the well when the packer mandrel 406 is extended downwardly through the packer 408. The packer mandrel 406 can be made any desired length, so that it can be extended downwardly through the packer 408, which allows the boring tool positioner 414 to be raised to different levels without moving or accidentally releasing the packer 408. Accordingly, after the packer 408 is set, the setdown weight causes the packer 408 to attach to the casing walls and the packer mandrel 406 is extended downwardly through the packer 408 until the boring tool positioner 414 reaches the first or lowest boring position in the production zone of the well. As described above, a drilling tool 20 (FIG. 2) is used to bore four holes in the casing, so that a perforation jet, such as jet 200, can perforate the production zone in the well. Thereafter, the tubing string 402 is lifted by a predetermined amount, which causes the packer mandrel 406 to slide through the packer 408 without disturbing the location of the packer 408. In that regard, the packer mandrel 406 has a sufficient length that the release collar 411 does not engage the slips 409, so that the packer 408 is not released from the casing. For example, the tubing string 402 may be lifted by two feet, which causes the boring tool positioner 414 to move upwardly in the hole by two feet. This also drags the bow spring anchor 416 upwardly by two feet. On top of the well, a spacer is inserted by the operators that fits around the tubing string between the lower surface of the elevators and the upper surface of the hydraulic slips that hold the tubing string. The spacer is placed around the tubing string between the upper surface of the hydraulic slips and the lower surface of the elevators and the elevators are lowered until the lower surface of the elevators rests on the spacer, which provides a predetermined space between the lower surface of the elevators and the top surface of the hydraulic slips. In that manner, the boring tool positioner is raised by a predetermined amount, which can be repeatably and reliably obtained using the same spacer.

Figure 33:
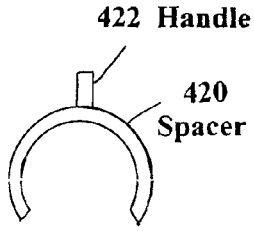
FIG. 33 is a top view of an embodiment of a spacer.

FIG. 33 discloses one implementation of a spacer 420. The spacer 420 has an inside diameter that is greater than the tubing string and has an opening that allows the spacer 420 to be placed around the tubing string, such as tubing string 402. For ease in handling, the spacer includes a handle 422 for placing and removing the spacer 420 around the tubing string 402 between the top surface of the hydraulic slips and the lower surface of the elevators. The spacer 420 has a predetermined length, such as, for example, two feet. When the elevators are lowered, the spacer 420 provides a predetermined space, such as two feet, between the bottom surface of the elevators and the upper surface of the hydraulic slips. In that manner, the boring tool positioner 414 is moved by two feet from its original level. New holes are then drilled in the casing at the two foot higher level. This process can be repeated several times, depending on the length of the packer mandrel 406. Different length spacers can be used to provide known spacings between the bored holes. The packer mandrel 406, however, must be sufficiently long, so that the release collar 416 does not engage the lower portion of the packer 408 to release the slips 409 and release the packer 408. Once multiple holes are drilled in the casing at the various levels, the drill tool can be removed and a perforation jet can be lowered into the boring tool positioner 414. The holes in the casing can then access openings for the perforation jet to perforate the production zone of the well. Then, the elevators can then be lifted and a new spacer placed between the lower surface of the elevators and the upper surface of the hydraulic slips, so that the boring tool positioner 414 accesses the next level of holes. The perforation jet can then blast perforations at the next level. This process can be repeated for all levels at which holes were drills in the casing. At each level, during both the boring and perforating procedures, the boring tool positioner 414 is rotated so that holes and perforations can be made in a plurality of directions. As the tubing string 402 is lowered, the boring tool positioner 414 is lowered and the bow spring anchor 416 is also moved in the casing. Typically, the bow spring anchor 416 will not rotate but move vertically in the casing, both upwardly and downwardly. However, rotational flexion of the string, when the string is pushed or pulled, may cause the bow spring to rotate slightly. To ensure that there is no rotation, another embodiment is disclosed in FIGS. 34-37 of a movable boring tool 424.

Figure 34:
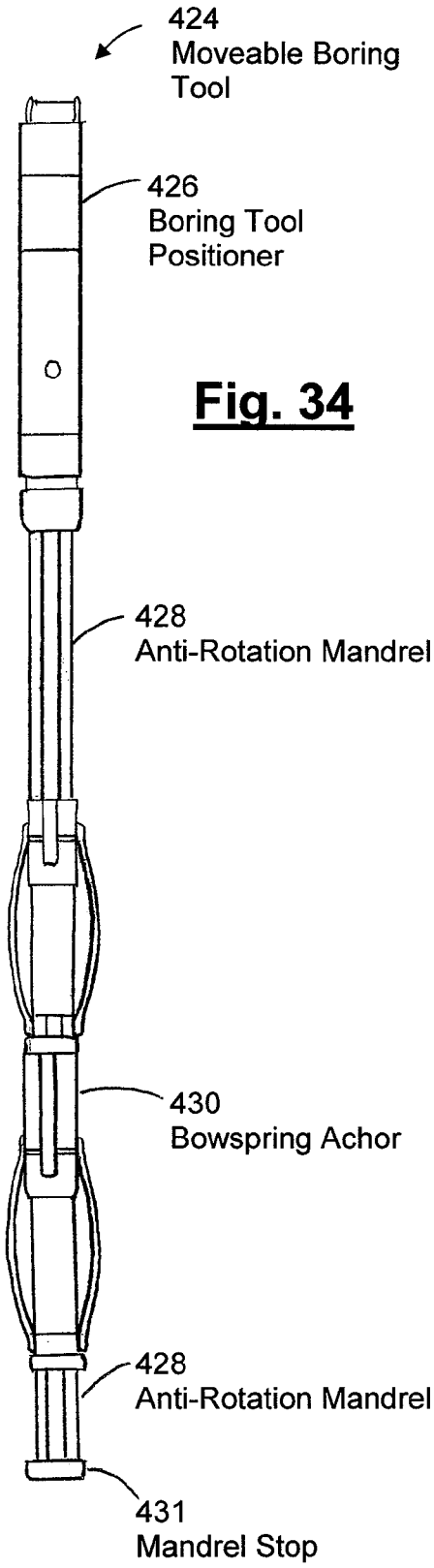
FIG. 34 is a side view of an embodiment of a movable boring tool.
Figure 35:
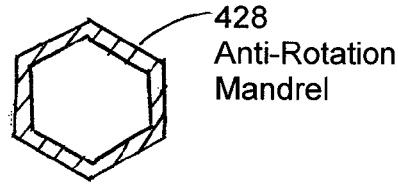
FIG. 35 is a cross-sectional view of an embodiment of an anti-rotation mandrel.
Figure 36:
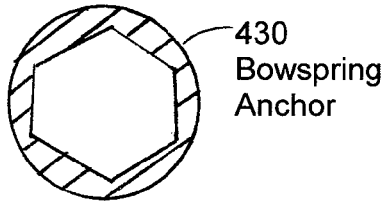
FIG. 36 is a cross-sectional view of an embodiment of a bow spring anchor.

FIG. 34 discloses a movable boring tool 424 that allows the bow spring anchor 430 to be positioned within the well and not move and not allow the boring tool positioner 426, illustrated in FIG. 34, to rotate as the tubing string moves upwardly and downwardly. The embodiments of FIGS. 34 through 37 uses an anti-rotation mandrel 428 that slides through the bow spring anchor 430 so that the bow spring anchor 430 does not move when the tubing string, and hence the boring tool positioner 426, is moved upwardly and downwardly to different positions in the production zone. As shown in FIG. 35, the anti-rotation mandrel 428 may have a shape, such as a hexagonal shape, which fits into the hexagonal shape of the bow spring anchor 430 that is illustrated in FIG. 36. In this manner, the anti-rotation mandrel 428 can slide easily within the interior of the bow spring anchor 430, but be held in a position so that the boring tool positioner 426 does not rotate as a result of the bow spring anchor 430 holding the anti-rotation mandrel 428 in a predetermined orientation. Mandrel stop 431 engages the bottom of the bow spring anchor 430 to allow extraction of the bow spring anchor. The boring tool positioner 426 engages the bow spring anchor 430 and drives it down through the hole until the boring tool positioner 426 is located at the lowest level at which perforations in the production zone are going to be made. The boring tool positioner 426 is then sequentially raised multiple times, using the process described above, which employs a spacer, such as spacer 420, to repeatably access the multiple levels at which holes are drilled in the casing. Since the bow spring anchor 430 remains anchored and does not move, the chances of rotation of the boring tool positioner 426, during the process of raising and lowering the boring tool positioner 426, is virtually eliminated. In this manner, alignment of the holes in the casing is highly accurate when the jetting device is lowered into the boring tool positioner 426. Although the anti-rotation mandrel 428 and the bow spring anchor 430 are shown as having hexagonal shapes to prevent rotation, any desired shape can be used, as well as key slots with key pins and other shapes, to prevent rotation.

Figure 37:
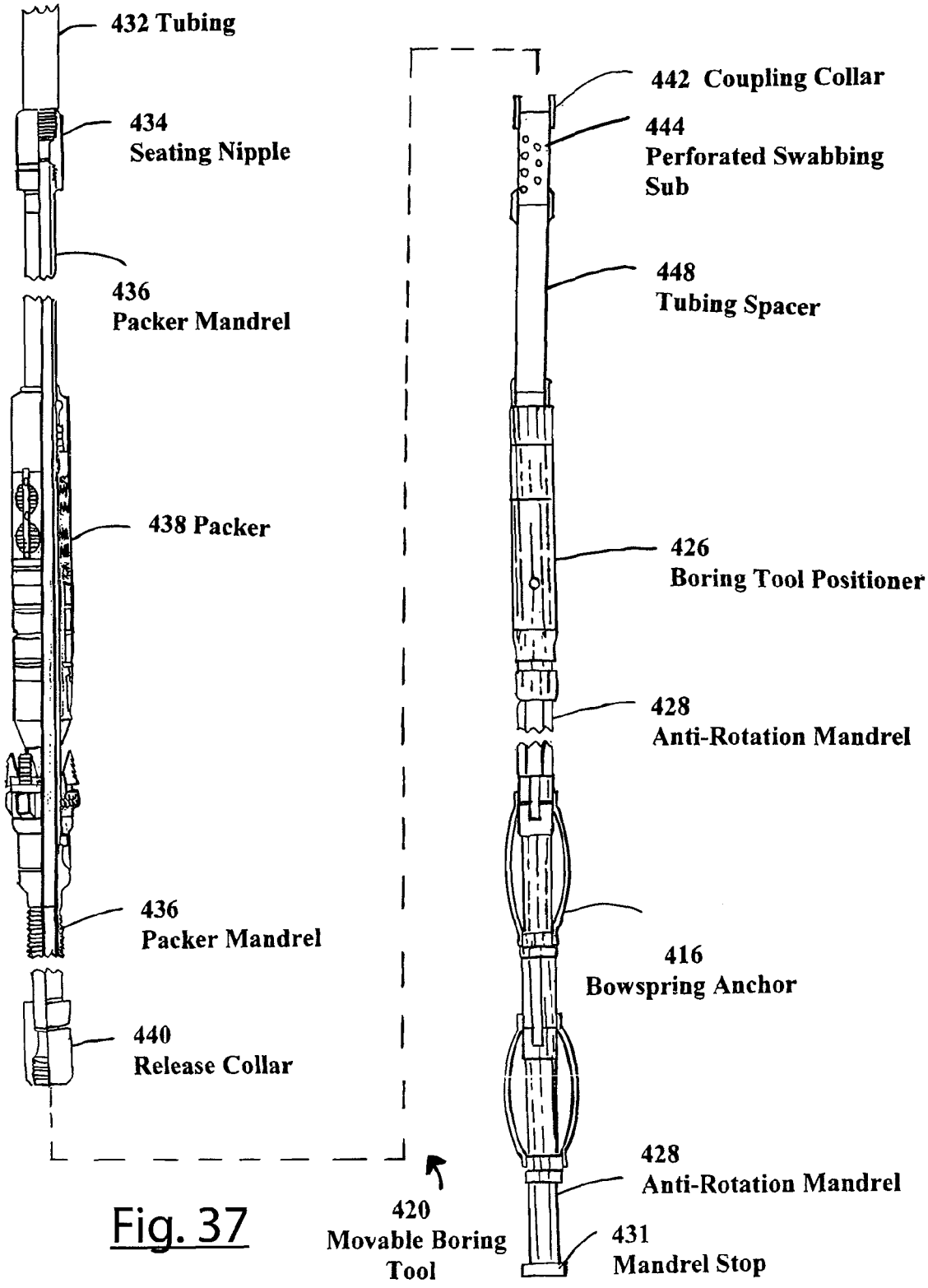
FIG. 37 is a side view of the various elements of another embodiment of a movable boring tool.

FIG. 37 discloses additional components of the embodiment that is illustrated in FIG. 34. As shown in FIG. 37, the tubing 432 that extends up the hole is attached to a seating nipple 434. The seating nipple 434 prevents the swab cups that are inserted into the tubing 432 to swab the tubing from passing below the seating nipple 434. The packer mandrel 436 extends through the packer 438 and includes a release collar 440 that is attached to the bottom of the packer mandrel 436. Packer 438 can be a retrievable R-type of packer mandrel, such as those that are available from Baker Oil Tools, a division of Baker Hughes, 9100 Emmott Road, Houston, Tex. 77040-3596. As disclosed above, the packer mandrel 436 must be longer than the distance in which perforations are to be made in the production zone to prevent the release collar 440 from releasing the packer mandrel 436 when the packer mandrel 436 is sequentially raised and spacers are placed around the tubing 432 at the surface of the well. The packer mandrel 436 comprises the standard packer mandrel that is used with the packer 438, which is round and slides through and rotates within the packer 438. The entire string illustrated in FIG. 37 is driven downwardly in the hole to set the bow spring anchor below the lowest level at which perforations will be made in the production zone. The string is then raised to raise the packer 438, so that the release collar 440 engages the packer 438 and the packer 438 is raised to the position at which it will be anchored in the casing. The anti-rotation mandrel 428 is sufficiently long so that the bow spring anchor 430 is not disturbed when the packer 438 is raised to a proper position for anchoring. The tubing 432 is then rotated, which rotates the packer mandrel 436, to set the packer 438 against the casing. Packer mandrel 436 is then lowered, so that the release collar 440 lowers, as well as the remaining portion of the string, including the perforated swabbing sub 444, the tubing spacer 448, the boring tool positioner 426, and the anti-rotation mandrel 428, until the boring tool positioner 426 is in the position at which a lower set of perforations will be made in the production zone.

As shown in FIG. 37, the release collar 440 is connected to the perforated swabbing sub 444 by the coupling collar 442. Since the packer 438 may slightly move during the process of setting the packer 438, the anti-rotation mandrel 428 should be made several feet longer than the packer mandrel 436. Tubing spacer 448 functions in the same manner as the tubing spacer 412, illustrated in FIG. 32, which allows the packer 438 to be placed in clean, unperforated casing higher in the hole. Rotation of the string does not occur below the boring tool positioner 426. As indicated above, the string can be rotated in the boring tool positioner 426 to access the various openings in the boring tool positioner 426. This rotation of the string 432 and the packer mandrel 436 does not affect the packer 438 once the packer mandrel 438 is set. The outer portion of the boring tool positioner 426 does not rotate with the string, as disclosed above, but is tied directly to the anti-rotation mandrel 428. The bow spring anchor 430, as described above with respect to FIGS. 34-36, anchors the anti-rotation mandrel 428 and prevents the anti-rotation mandrel 428 from rotating in the hole, so that the boring tool positioner 428 can be accurately located when repositioned to perform the jet blasting procedure. The mandrel stop 431 allows the bow spring anchor 430 to be retrieved upon removal of the string.

In operation, the embodiment of FIGS. 32-37 allows the boring tool positioner 426 to drill holes and perforate a production zone at multiple levels, restricted only by the length of the packer mandrel 436 and the anti-rotation mandrel 428. The anti-rotation mandrel 428 prevents the boring tool positioner 426 from rotating, since the bow spring anchor 430 is anchored within the casing and does not move vertically, and does not allow the boring tool positioner 426 to rotate. Hence, angular position of the boring tool positioner 426 is maintained in a highly accurate manner. Further, the use of spacers, such as spacer 420, illustrated in FIG. 33, allows the boring tool positioner 426 to be very accurately located in a vertical direction, since the spacer is hard set between the upper surface of the hydraulic slips and the lower surface of the elevators. Of course, any type of spacer can be used, as long as it is capable of carrying the weight of the entire string. In addition, various shapes and other designs can be used, as long as the spacer provides a space between the lower portion of the elevators and the upper surface of the hydraulic slips. Alternatively, the elevators can be moved a precise distance, which can be measured by the operator. In this manner, a repeatable depth may be achievable for the boring tool positioner 426. The embodiment illustrated in FIG. 37 allows multiple layers of holes to be drilled in the casing and these holes to be precisely and repeatably located after the drilling tool is removed and the perforation jet is placed in the boring tool positioner 426. Accurate location of the opening in the boring tool positioner 426 with the hole that is bored in the casing prevents the jet blaster from being lodged and stuck between the boring tool positioner 426 and the opening in the casing.

In the various embodiments disclosed herein, the tubing string 436 can be rotated along with the packer mandrel 436, release collar 440, coupling collar 442, perforated swabbing sub 444 and tubing spacer 448, which rotates the internal portion of the boring tool positioner 426, by attaching a large wrench to the tubing 432 at the surface. An operator can rotate the tubing string in a first direction, using a large wrench, such as a 24 inch wrench, until the operator feels the snap of the spring 142 setting the boring tool positioner 426 on the incline planes. The operator then pulls the device in the opposite direction to ensure that the boring tool positioner 426 is properly seated along the incline planes. Once the holes are drilled in the casing or the jetting is done, the operator then rotates the tubing string 402 again until the operator detects another vibration caused by the spring when the boring tool positioner 426 seats in the next position. The operator again reverses the direction of rotation of the string to ensure that the incline planes are properly seated. The operator can then proceed with either the drilling or the jetting process. This process is repeated for each opening in the boring tool positioner 426, for example, four times at each level. It has been empirically determined that the amount of rotation of the wrench at the surface does not correspond with the amount of rotation of the string within the boring tool positioner 428. For example, a full 360° rotation of the boring tool positioner 426 may only result in approximately 180° or 190° of rotation on the surface. This may be due to the rotational flexion of the tubing 432 at long distances, which, in some wells, may be over a mile between the surface and the boring tool positioner 426. Hence, the process of detecting the vibration created by the spring 142 (FIGS. 17 and 18) allows an accurate way of detecting the proper setting of the boring tool positioner 426 in the various settings, such as the four settings illustrated in the embodiments disclosed above.

Figure 38:
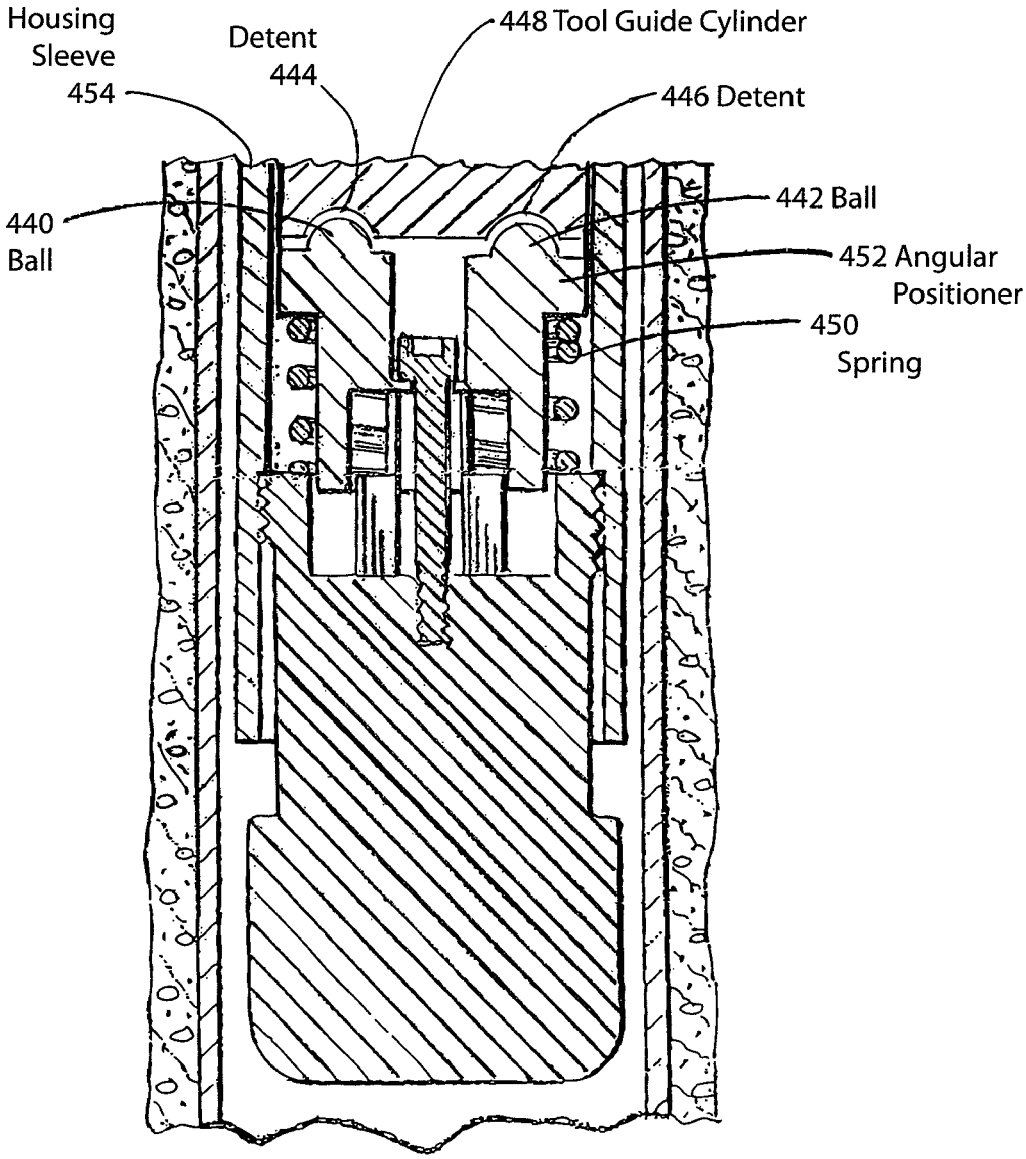
FIG. 38 is a cross-sectional view of an embodiment of a ball and detent locking mechanism.

FIG. 38 is a cutaway view of a ball and detent arrangement for locking the tool guide cylinder 448 in place. The tool guide cylinder 448 has two detents 444, 446 that engage the balls 440, 442 on the angular positioner 452. Balls 440, 442 are held within the detents 444, 446 by the upward pressure of spring 450 on the angular positioner 452. In this manner, the tool guide cylinder 448 can be releasably rotated and releasably latched into place at each 90° position, or other angular position, depending upon the location of the detents, to hold the tool guide cylinder 448 in alignment with the apertures on the housing sleeve 454.

Figure 39:
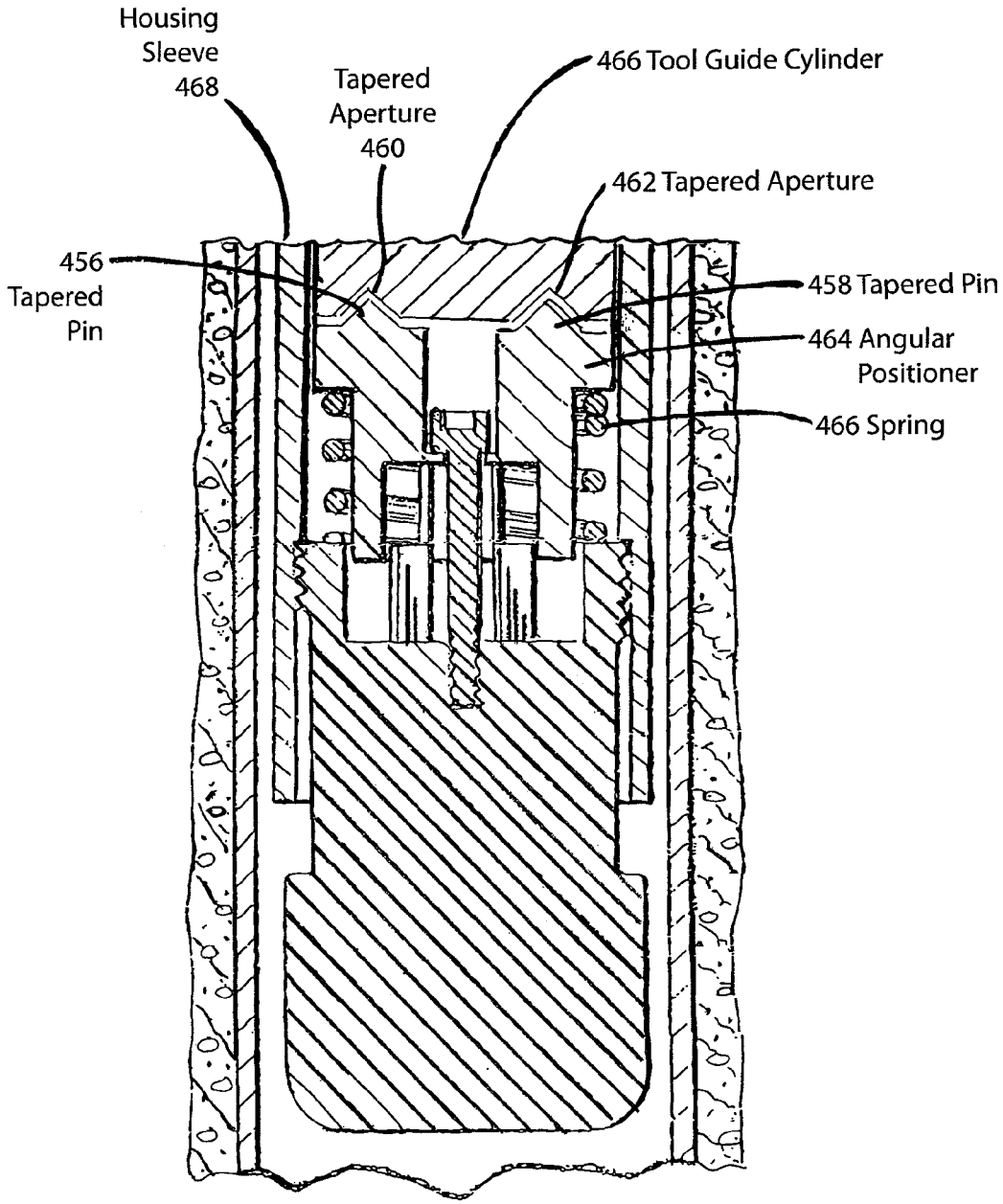
FIG. 39 is a cross-sectional view of an embodiment of a tapered pin and tapered aperture locking mechanism.

FIG. 39 is another embodiment of a device for releasably latching the tool guide cylinder. As shown in FIG. 39, tapered pins 456, 458 engage the tapered apertures 460, 462. The angular positioner 464 is held in place by the spring 466. This process locks the tool guide cylinder 466 in predetermined positions so that the tool guide cylinder 466 can be aligned with the apertures in the housing sleeve 468.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A movable boring assembly for drilling a plurality of holes in a well casing and jetting a well production zone through said plurality of holes at a plurality of levels and in a plurality of directions comprising:

a boring tool positioner that orients a drill tool to cut said plurality of holes in said plurality of directions in said well casing and orient a perforation jet in said plurality of holes to perforate said well production zone in said plurality of directions, said boring tool positioner comprising:

a housing sleeve having a plurality of apertures distributed at different locations on said housing sleeve;

a tool guide cylinder positioned rotatably in said housing sleeve that orients said drill tool and said perforation jet with said plurality of apertures;

an angular positioner that controls rotational movement of said tool guide cylinder in said housing sleeve in a manner that causes a releasable, self-latching engagement between said tool guide cylinder and said housing sleeve to accurately and repeatably align said tool guide cylinder with said housing sleeve so that said drill tool and said perforation jet are accurately and repeatably aligned with said plurality of apertures;

an antirotation mandrel coupled to a lower end of said boring tool positioner;

a bow spring anchor that engages said antirotation mandrel to prevent said boring tool positioner from rotating;

a releasable packer that releasably couples to said well casing;

a packer mandrel that rotates in said releasable packer to orient said boring tool positioner in said plurality of directions to cut said plurality of holes in said well casing and to orient said perforation jet in said plurality of holes, and to vertically move said boring tool positioner to more than one level in said well to bore holes and perforate production zones through said holes in said well casing at more than one level.

2. The movable boring assembly of claim 1 wherein said angular positioner comprises a ratchet and paw.

3. The movable boring assembly of claim 1 wherein said angular positioner comprises a spring-loaded ball and detent.

4. The movable boring assembly of claim 1 wherein said angular positioner comprises a retractable tapered pin and mating tapered aperture.

5. The movable boring assembly of claim 1 wherein said tool guide cylinder has a curved channel that extends from a proximal end of said tool guide cylinder, and is substantially centered on a longitudinal axis of said tool guide cylinder, to a distal end and exists said tool guide cylinder at an angle of approximately 90° to said axis.

6. The movable boring assembly of claim 5 further comprising:

a socket disposed at said tool guide cylinder that receives and guides said drill tool and said perforation jet into and through said curved channel.

7. The movable boring assembly of claim 6 wherein said socket further comprises a center bore that receives and retains a drill motor, longitudinal slots formed in said socket along said center bore, spiral shoulders formed on said proximal end of said socket in said center bore that engage radially extending ears from a transmission of said drill motor.

8. The movable boring tool assembly of claim 7 further comprising:

a support that connects said boring tool positioner to a tubing string that extends to the surface of said well.

9. The movable boring tool assembly of claim 8 wherein said support comprises a carrier pipe.

10. The movable boring tool assembly of claim 8 further comprising:

a boring tool positioner bow spring anchor that is coupled to said housing sleeve that holds said housing to said well casing to prevent rotation and centers said boring tool positioner in said well casing.

11. A boring tool positioner that orients a drill tool to cut a plurality of holes in a plurality of directions in a well casing and reliably and accurately reorients a perforation jet in said plurality of holes to perforate a production zone through said plurality of holes in said well casing comprising:

a housing sleeve having a plurality of apertures distributed around a circumferential wall on said housing sleeve;

a tool guide cylinder positioned rotatably in said housing sleeve that orients said drill tool and said perforation jet with said plurality of apertures;

an angular positioner that controls rotational movement of said tool guide cylinder in said housing sleeve in a manner that causes a releasable, self-latching engagement between said tool guide cylinder and said housing sleeve to accurately and repeatably align said tool guide cylinder with said housing sleeve so that said drill tool and said perforation jet are accurately and repeatably aligned with said plurality of apertures.

12. The boring tool positioner of claim 11 wherein said angular positioner comprises a ratchet and paw.

13. The boring tool positioner of claim 11 wherein said angular positioner comprises a spring-loaded ball and detent.

14. The boring tool positioner of claim 11 wherein said angular positioner comprises a retractable tapered pin and mating tapered aperture.

15. The boring tool positioner of claim 11 wherein said tool guide cylinder has a curved channel that extends from a proximal end of said tool guide cylinder, and is substantially centered on a longitudinal axis of said tool guide cylinder, to a distal end and exists said tool guide cylinder at an angle of approximately 90° to said axis.

16. The boring tool positioner of claim 15 further comprising:

a socket disposed at said tool guide cylinder that receives and guides said drill tool and said perforation jet into and through said curved channel.

17. The boring tool positioner of claim 16 wherein said socket further comprises a center bore that receives and retains a drill motor, longitudinal slots formed in said socket along said center bore, spiral shoulders formed on said proximal end of said socket in said center bore that engages radially extending ears from a transmission of said drill motor.

18. The boring tool positioner of claim 17 further comprising:

a support that connects said boring tool positioner to a tubing string that extends to the surface of said well.

19. The boring tool positioner of claim 18 further comprising:

a boring tool positioner bow spring anchor that is coupled to said housing sleeve that holds said housing to said well casing to prevent rotation and centers said boring tool positioner in said well casing.

20. A method of orienting a drill tool to cut a plurality of holes in a plurality of directions in a well casing of a well and reliably and accurately reorienting a perforation jet in said plurality of holes to perforate a production zone of said well through said plurality of holes in said well casing comprising:

providing a housing sleeve having a plurality of apertures distributed around a circumferential wall of said housing sleeve;

holding said housing sleeve so that said housing sleeve does not rotate in said well;

rotating a tool guide cylinder in said housing sleeve;

aligning said tool guide cylinder in said housing sleeve so that said drill tool and said perforation jet are accurately and repeatably aligned with said apertures.

21. The method of claim 20 wherein said process of holding said housing sleeve comprises:

anchoring said housing sleeve to said well casing.

22. The method of claim 20 wherein said process of holding said housing sleeve comprises:

anchoring an antirotational mandrel to said well casing that allows said housing sleeve to be moved vertically in said well but prevents rotational movement of said housing sleeve.

23. The process of claim 22 wherein said process of rotating said tool guide cylinder in said housing sleeve comprises:

rotating a packer mandrel that is connected to said tool guide cylinder.

24. The method of claim 23 wherein said process of aligning said tool guide cylinder in said housing sleeve comprises:

using an angular positioner that releasably sets an angular position of said tool guide cylinder in said housing sleeve using a self-latching mechanism.

* * * * *